US010207829B2

(12) United States Patent
Saito et al.

(10) Patent No.: US 10,207,829 B2
(45) Date of Patent: Feb. 19, 2019

(54) FUNNEL COMPONENT AND MANUFACTURING METHOD FOR MANUFACTURING PACKAGING CONTAINER USING FUNNEL COMPONENT

(71) Applicant: TOPPAN PRINTING CO., LTD., Tokyo (JP)

(72) Inventors: Takeshi Saito, Tokyo (JP); Shinji Kaneyuki, Tokyo (JP); Noriyuki Sasaki, Tokyo (JP); Jyun Sada, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 507 days.

(21) Appl. No.: 14/375,249

(22) PCT Filed: Dec. 28, 2012

(86) PCT No.: PCT/JP2012/008418
§ 371 (c)(1),
(2) Date: Jul. 29, 2014

(87) PCT Pub. No.: WO2013/114516
PCT Pub. Date: Aug. 8, 2013

(65) Prior Publication Data

US 2014/0366490 A1 Dec. 18, 2014

(30) Foreign Application Priority Data

Feb. 1, 2012 (JP) ..... 2012-020021
Feb. 1, 2012 (JP) ..... 2012-020022
(Continued)

(51) Int. Cl.
*B65B 1/02* (2006.01)
*B31F 1/00* (2006.01)
(Continued)

(52) U.S. Cl.
CPC ..... *B65B 1/02* (2013.01); *B31F 1/0093* (2013.01); *B65B 1/06* (2013.01); *B65D 3/14* (2013.01);
(Continued)

(58) Field of Classification Search
CPC ..... B65D 3/14; B65D 25/42; B65D 77/2056; B65D 77/40; B65D 83/06;
(Continued)

(56) References Cited

U.S. PATENT DOCUMENTS 2,399,545 A 4/1946 Davis ..... A61F 13/02 602/55
2,721,810 A 10/1955 Schram
(Continued)

FOREIGN PATENT DOCUMENTS

EP 2426080 A1 3/2012
GB 2 232 141 A 12/1990
(Continued)

OTHER PUBLICATIONS

New Zealand Office Action dated May 18, 2015 in corresponding New Zealand Patent Application No. 622498.
(Continued)

*Primary Examiner* — Sameh Tawfik

(57) ABSTRACT

A funnel component is manufactured by the following processes: forming a first intermediate product that is tapered, by rolling the blank material; forming a second intermediate product by folding back and welding a narrow opening side portion of the first intermediate product; forming a third intermediate product having the side wall portion by folding the wide opening side portion of the second intermediate product back outward; forming a cylindrical discharge portion forming the narrow opening side portion, a first tapered portion that connects to the discharge portion
(Continued)

and has a tapered shape, and a second tapered portion that has a tapered shape having a taper angle less than the first tapered portion, by performing a drawing process on the third intermediate product.

11 Claims, 23 Drawing Sheets

(30) Foreign Application Priority Data

Feb. 1, 2012 (JP) ..... 2012-020023
Feb. 2, 2012 (JP) ..... 2012-021063

(51) Int. Cl.

| | |
|---|---|
| ***B65B 1/06*** | (2006.01) |
| ***B65D 83/06*** | (2006.01) |
| ***B67C 11/02*** | (2006.01) |
| ***B65D 25/42*** | (2006.01) |
| ***B65D 77/20*** | (2006.01) |
| ***B65D 77/40*** | (2006.01) |
| ***B65D 3/14*** | (2006.01) |
| *B31B 50/84* | (2017.01) |
| *B31B 50/81* | (2017.01) |
| *B31B 105/00* | (2017.01) |
| *B31B 110/10* | (2017.01) |
| *B31B 120/00* | (2017.01) |

(52) U.S. Cl.
CPC ..... *B65D 25/42* (2013.01); *B65D 77/2056* (2013.01); *B65D 77/40* (2013.01); *B65D 83/06* (2013.01); *B67C 11/02* (2013.01); *B31B 50/81* (2017.08); *B31B 50/84* (2017.08); *B31B 2105/00* (2017.08); *B31B 2110/10* (2017.08); *B31B 2120/002* (2017.08); *B65D 2577/205* (2013.01); *B65D 2577/2008* (2013.01); *B65D 2577/2091* (2013.01)

(58) Field of Classification Search
CPC .... B65D 2577/2008; B65D 2577/2091; B31B 49/02; B31B 2201/9085; B31B 2217/062; B31B 2217/108; B65B 1/02; B65B 1/06; B31C 1/06; B31F 1/0093
USPC ..... 493/108
See application file for complete search history.

(56) References Cited

U.S. PATENT DOCUMENTS

| | | | | |
|---|---|---|---|---|
| 2,776,787 | A | 1/1957 | Nicol | |
| 2,894,660 | A | 7/1959 | Campbell | B65D 5/726 222/528 |
| 3,171,449 | A * | 3/1965 | Ellms | B65G 69/181 141/330 |
| 3,235,165 | A | 2/1966 | Jackson | B65D 17/502 221/302 |
| 3,603,358 | A * | 9/1971 | Mallindine | B44D 3/128 141/343 |
| 3,964,670 | A | 6/1976 | Amneus | |
| 4,120,420 | A | 10/1978 | Oirksing | 222/460 |
| 4,351,740 | A * | 9/1982 | Joshi | B65B 1/06 141/1 |
| 4,397,406 | A * | 8/1983 | Croley | B65D 5/726 222/105 |
| 4,460,634 | A | 7/1984 | Hasegawa | |
| 4,534,751 | A * | 8/1985 | Fortuna | B29C 66/12441 156/294 |
| 4,715,528 | A | 12/1987 | Kjelgaard et al. | |
| 4,735,837 | A | 4/1988 | Miyasaka | 428/192 |
| 4,743,249 | A | 5/1988 | Loveland | A61K 9/7084 424/447 |
| 4,771,937 | A | 9/1988 | Kamada et al. | |
| 4,863,036 | A | 9/1989 | Heijenga | |
| 4,889,234 | A | 12/1989 | Sorensen et al. | |
| 5,018,695 | A | 5/1991 | Bishop | |
| 5,081,820 | A * | 1/1992 | Nedstedt | B29C 65/02 425/388 |
| 5,363,982 | A * | 11/1994 | Sadlier | B65D 3/22 229/103.11 |
| 5,487,929 | A | 1/1996 | Rusincovitch, Jr. et al. | |
| 5,524,759 | A | 6/1996 | Herzberg et al. | |
| 5,949,032 | A | 9/1999 | Wurzburger | |
| 6,026,953 | A | 2/2000 | Nakamura et al. | |
| 6,146,729 | A | 11/2000 | Nihda | B65D 55/06 215/251 |
| 6,165,115 | A * | 12/2000 | Rea | B29C 65/02 220/616 |
| 6,206,134 | B1 | 3/2001 | Stark et al. | |
| 6,283,178 | B1 * | 9/2001 | Way | B65B 37/00 141/231 |
| 6,309,745 | B1 | 10/2001 | Willms et al. | |
| 6,495,229 | B1 | 12/2002 | Carte et al. | |
| 7,789,262 | B2 | 9/2010 | Niederer | B65D 77/2032 220/359.2 |
| 7,947,366 | B2 | 5/2011 | Ishiwatari et al. | |
| 8,114,451 | B2 | 2/2012 | Sierra-Gomez et al. | |
| 2001/0015356 | A1 | 8/2001 | Jud | |
| 2002/0146115 | A1 | 10/2002 | Zohn et al. | |
| 2003/0047277 | A1 | 3/2003 | Bell et al. | |
| 2003/0077414 | A1 | 4/2003 | Clark | |
| 2005/0077297 | A1 | 4/2005 | Marshburn et al. | |
| 2005/0167311 | A1 | 8/2005 | Tonsfeldt et al. | |
| 2006/0195053 | A1 | 8/2006 | Oelund et al. | |
| 2006/0216451 | A1 | 9/2006 | Weiner et al. | |
| 2006/0289542 | A1 | 12/2006 | Schedi et al. | |
| 2008/0073240 | A1 | 3/2008 | Bowers | 206/532 |
| 2011/0036454 | A1 * | 2/2011 | Saito | B65B 39/007 141/331 |
| 2011/0036868 | A1 * | 2/2011 | Gotoh | B65D 3/26 141/351 |
| 2011/0259887 | A1 * | 10/2011 | Gotoh | B32B 3/266 220/266 |
| 2012/0055941 | A1 * | 3/2012 | Messerschmid | B29C 51/082 220/694 |
| 2014/0007978 | A1 * | 1/2014 | Cheikh | A47J 31/404 141/311 R |

FOREIGN PATENT DOCUMENTS

| | | |
|---|---|---|
| JP | 2000-255648 | 9/2000 |
| JP | 2001-233318 | 8/2001 |
| JP | 2002-240167 | 8/2002 |
| JP | 2003-341708 | 12/2003 |
| JP | 2004-18036 | 1/2004 |
| JP | 2008-273580 A | 11/2008 |
| JP | 2009-184169 | 8/2009 |
| JP | 2009-280286 | 12/2009 |
| JP | 2010-58834 | 3/2010 |
| JP | 2010-254321 | 11/2010 |
| JP | 2010-254322 | 11/2010 |
| JP | 2010-254326 | 11/2010 |
| JP | 2011-84329 | 4/2011 |
| JP | 2011-93614 | 5/2011 |
| JP | 2012-035873 | 2/2012 |
| JP | 2013-56700 | 3/2013 |

OTHER PUBLICATIONS

International Search Report dated Apr. 16, 2013, in corresponding International Patent Application No. PCT/JP2012/008418.
Office Action issued from the United States Patent and Trademark Office dated Sep. 6, 2016 in U.S. Appl. No. 14/342,928.
Japanese Office Action dated May 7, 2015 in corresponding Japanese Patent Application No. 2011-197665.
Chinese Office Action dated Mar. 12, 2015 in corresponding Chinese Patent Application No. 201280043639.7.

(56) References Cited

OTHER PUBLICATIONS

Extended European Search Report dated Apr. 23, 2015 in corresponding European Patent Application No. 12830314.6.
Office Action issued from the United States Patent and Trademark Office dated Mar. 21, 2016 in U.S. Appl. No. 14/342,928.
U.S. Appl. No. 14/342,928, filed Mar. 5, 2014, Takashi Terayama et al., Toppan Printing Co., Ltd.
Notice of Allowance dated Feb. 26, 2018, in copending U.S. Appl. No. 14/342,928, 11 pgs.

* cited by examiner

FUNNEL COMPONENT AND MANUFACTURING METHOD FOR MANUFACTURING PACKAGING CONTAINER USING FUNNEL COMPONENT

CROSS-REFERENCE TO RELATED APPLICATIONS

This application is a U.S. National Stage Application under 35 U.S.C. 371 of International Patent Application No. PCT/JP2012/008418, filed Dec. 28, 2012, which claims foreign priority to Japanese Patent Application No. 2012-020021, filed Feb. 1, 2012, Japanese Patent Application No. 2012-020022, filed Feb. 1, 2012, Japanese Patent Application No. 2012-020023, filed Feb. 1, 2012, Japanese Patent Application No. 2012-021063, filed Feb. 2, 2012, all of which are incorporated herein by reference.

BACKGROUND

Field

The present invention relates to funnel components that allow fluid contents such as powdery, granular, and liquid contents to be packaged and facilitate transfer of the contents from one case to another case or the like, and a manufacturing method for manufacturing packaging containers in which the funnel components are used.

Description of Related Art

As a package that facilitates transfer of contents such as powdery or granular food like instant coffee to a storage container or a tank of a coffee machine, a package as disclosed in Patent Literature 1 has been known. The package for refilling as disclosed in Patent Literature 1 includes a cylindrical container body, a funnel component inserted in an open end portion of the container body, and a membrane for sealing the open end of the container body. When the package for refilling is used, in a state where the membrane portion is in contact with an opening portion of a container, such as a storage container or a tank, to be filled, the package for refilling is pressed against the container to be filled, to break the membrane, thereby allowing the contents to be transferred along an inner surface of the funnel component into the container to be filled.

A flange portion having a flat top surface and a certain width is preferably provided in the open end portion of the container body, in order to assuredly seal a cup-shaped container body with a lid member such as a membrane with stability. A technique associated with a method for forming such a flange portion is disclosed in Patent Literature 2. According to Patent Literature 2, a curled top portion formed in an open end portion of a paper cup is sandwiched and squeezed between an ultrasonic horn and a cup receiving mold, and is simultaneously heated and welded by ultrasonic vibration being applied, thereby forming a cup flange portion having a flat top surface. Other than this technique, a technique for forming a flange portion having a flat top surface by a curled top formed in an open end portion of a paper cup being sandwiched between a pair of molds, and heated and pressed, is known.

Such a packaging container which is filled with contents and in which the contents are packaged may be subjected to an environment where air pressure inside the packaging container becomes different from air pressure outside the packaging container during circulation. In a case where, for example, packaging containers which are filled with contents and in which the contents are packaged in summer in which the temperature is high are in shops in winder in which the temperature is low, air pressure inside the packaging containers is reduced relative to air pressure outside the packaging containers, and the side surface portions of the packaging containers are recessed toward the inside of the packaging containers. Therefore, a problem may arise that the design of the packaging containers is degraded. On the other hand, in a case where, for example, packaging containers which are filled with contents and in which the contents are packaged in a place such as a flat land in which the altitude is relatively low, are circulated and placed in a place in which the altitude is high, air pressure inside the packaging containers is increased relative to air pressure outside the packaging containers, and the side surface portions of the packaging containers expand outward of the packaging containers. Therefore, problems may arise that the design of the packaging containers is degraded and contents are ejected due to, for example, breakage caused by a small impact. In order to solve the problems, in Patent Literature 3, a container is suggested in which a laminated member of the side surface portion of the container is formed so as to be partially separable, and, particularly when an internal pressure is reduced, an inner layer of the laminated member is separated and expand toward the inside of the container, to alleviate reduction of pressure in the container, thereby preventing the side surface portion of the container from being recessed.

PRIOR ART DOCUMENTS LIST

Patent Documents

Patent Document 1: Japanese Laid-Open Patent Publication No. 2010-254326

Patent Document 2: Japanese Laid-Open Patent Publication No. 2009-184169

Patent Document 3: Japanese Laid-Open Patent Publication No. 2011-93614

SUMMARY

In recent years, from the viewpoint of resource saving and facilitation of disposal, an amount of resin to be used for packaging containers is required to be reduced. Therefore, in the package for refilling as disclosed in Patent Literature 1, a container body in which a funnel component formed by a material that includes paper as a main component being molded is used instead of a funnel component formed by a resin being molded, and usage of metal such as aluminium is minimized, is required to be used.

The funnel component disclosed in Patent Literature 1 includes not only a funnel used for extracting contents but also a side wall through which the funnel is attached to the container body. However, a method for forming the funnel and the side wall by using a material that includes paper as a main component has not been known. It can be considered that a funnel component is formed by using pulp molding. However, problems arise that cost for introducing facilities is high and mass production is limited.

Further, the side wall portion of the cup-shaped container as described above includes portions having different thicknesses, that is, includes: a portion in which a sheet member is layered; and the other portions. In a case where ultrasonic welding is performed on the curled top portion which is being squeezed by an ultrasonic horn as described in Patent Literature 2, a problem arises that when a clearance between the ultrasonic horn and a receiver jig is aligned with the portion (the thickest portion) in which the sheet member is layered, the other portions cannot be sealed due to insufficient pressure, whereas when the clearance between the ultrasonic horn and the receiver jig is aligned with portions other than the portion in which the sheet member is layered, pressure and ultrasonic vibration are concentrated on the thickest portion, and scorching is likely to occur. In particular, when the thickness of the sheet member is increased, occurrence of scorching becomes significant.

Moreover, the clearance between the ultrasonic horn and the receiver jig may be widened only in a portion corresponding to the portion in which the sheet member is layered, and a pressure may be applied by the ultrasonic horn almost uniformly over the entirety of the curled top portion. However, in this case, the layered portion is formed so as to have a relatively great thickness among the formed flange portion, and therefore, when the flange portion is thereafter sealed with a film, a problem arises that a sealing pressure is not uniform. Namely, also when the flange portion is sealed with the film, the flange portion and the film overlaying each other are sandwiched and pressed between a seal head and a seal receiving table from thereabove and therebelow. Therefore, when the thickness of the flange portion is not uniform, a sealing pressure is not uniform, either, whereby sealing may become poor.

On the other hand, in a method in which the curled top portion is heated and pressed, although scorching does not occur, since slidability of the heated sheet member is reduced, a problem arises that buckling and crinkling are likely to occur during squeezing of the curled top portion.

An object of the present invention is to make available a manufacturing method for manufacturing a funnel component which can be produced in large amounts and at low cost by using a material that includes paper as a main component, and a manufacturing method for manufacturing a packaging container using the funnel component. Another object of the present invention is to make available a cup container that is formed without scorching and crinkling in a flange portion and that has the flange portion which is less likely to be deformed after molding, and a manufacturing method for manufacturing a packaging container using the cup container. Still another object of the present invention is to make available a manufacturing method for manufacturing a packaging container in which a funnel component produced by using a material that includes paper as a main component is joined into a cup-shaped container body produced by using a material that includes paper as a main component. Still another object of the present invention is to make available a manufacturing method for manufacturing a packaging container that does not allow degradation of its design such as an outer appearance even if an internal pressure of the packaging container is changed relative to an external pressure.

The present invention is directed to a manufacturing method for manufacturing, by using a sheet member including paper and a sealant, a funnel component that includes: a funnel portion having a diameter reduced from a wide opening side toward a narrow opening side; and a side wall portion that connects to a wide opening side portion of the funnel portion and surrounds an outer surface of the funnel portion. The manufacturing method for manufacturing the funnel component according to the present invention includes the steps of: forming a blank material surrounded by an arc, a pair of straight lines that extends in a radial direction of the arc, and a corrugated line that extends so as to form an arc that is concentric with the arc and has a radius less than the arc, by punching the sheet member by using a die; forming a first intermediate product that is tapered, by rolling the blank material, and causing portions near the paired straight lines to overlap each other and be welded to each other; forming a second intermediate product by folding back and welding the corrugated line portion of a narrow opening side portion of the first intermediate product over the entirety of a circumference of the corrugated line portion; forming a third intermediate product having the side wall portion by folding the wide opening side portion of the second intermediate product back outward over the entirety of a circumference of the wide opening side portion; and forming a cylindrical discharge portion forming the narrow opening side portion, a first tapered portion that connects to the discharge portion and has a tapered shape, and a second tapered portion that connects to the first tapered portion and has a tapered shape having a taper angle less than the first tapered portion, by performing a pressing process on the third intermediate product by using a mold to perform a drawing process.

Further, the present invention is directed to a manufacturing method for manufacturing a packaging container having a funnel component that includes: a funnel portion having a diameter reduced from a wide opening side toward a narrow opening side; and a side wall portion that connects to a wide opening side portion of the funnel portion and surrounds an outer surface of the funnel portion. In the manufacturing method for manufacturing the packaging container according to the present invention, the funnel component is firstly formed by the manufacturing method for manufacturing the funnel component described above. The manufacturing method for manufacturing the packaging container according to the present invention includes the step of: the forming a cup-shaped container body having a cylindrical side wall, a bottom portion, and an open end; inserting the funnel component through the open end of the container body thereinto so as to face the wide opening side portion of the funnel component toward the bottom portion of the container body, and joining an outer surface of the side wall portion to an inner circumferential surface of the funnel component; and sealing the open end of the container body with a film that is to be broken by a pressing force after the container body is filled with contents.

Further, the step of forming the container body includes the steps of: forming a cup-shaped intermediate product having: a cylindrical side wall and a bottom portion formed of a sheet member including paper and a sealant; and an open end; forming a first curling portion by curling an open end portion of the side wall outward; softening the sealant by heating a portion, on a bottom portion side, of the first curling portion; forming a second curling portion by further curling outward the first curling portion having the sealant softened; and forming a flange portion by pressing the second curling portion.

Further, the step of joining the outer surface of the side wall portion to the inner circumferential surface of the funnel component includes the steps of: heating and softening the sealant on the outer surface of the side wall portion; holding the funnel component in a state where the side wall portion of the funnel component is contracted in a circumferential direction such that an outer diameter of the side wall portion is less than an inner diameter of the open end of the container body, and inserting the funnel component into the container body so as to face the wide opening side portion toward the bottom portion of the container body; and pressing and widening the side wall portion of the funnel component inserted in the container body, and pressing and attaching the side wall portion to an inner surface of the side wall of the container body.

Further, the side wall has a rigidity higher than the bottom portion, and the step of forming the intermediate product includes the steps of: forming a plurality of ruled lines on one of surfaces of a bottom member formed of a sheet member including paper and a sealant so as to radially extend as viewed from a center portion; and forming the bottom portion by sealing the bottom member having the ruled lines, and a lower end side portion of the side wall with each other such that a surface on which the ruled lines are formed is positioned outside.

According to the present invention, funnel components can be manufactured in large amounts and at low cost by using a sheet member that includes paper as a main component.

Further, according to the present invention, ultrasonic welding is not performed, and therefore scorching of the flange portion can be avoided. Further, a sealant is temporarily softened during forming of a curling portion, and the curling portion is further curled. Therefore, the curled portion is welded and stably maintained, and crinkling can be reduced during pressing of the curling portion. Further, the sealant is softened, and the curling portion is then further curled, to increase the degree of amount, and to sufficiently weld the curled portion. Therefore, deformation due to environmental change after the molding can be reduced.

Further, according to the present invention, a funnel component manufactured by using a material that includes paper as a main component can be joined into a cup-shaped container body manufactured by using a material that includes paper as a main component. Therefore, a resin usage ratio for the packaging container can be significantly reduced. Furthermore, the funnel component is inserted into the container body in a state where the outer diameter of the side wall portion is reduced so as to be less than the inner diameter of the container body. Therefore, generation of resin scraps due to friction of the softened sealant, and reduction of welding strength due to the sealant being scratched are significantly reduced.

According to the present invention, a packaging container can be provided which does not degrade its design even when an internal pressure is changed relative to an external pressure. Further, the rigidity of the bottom portion of the packaging container is reduced so as to be lower than the rigidity of the side surface portion, and a plurality of ruled lines are formed so as to radially extend as viewed from the center portion of the bottom portion, thereby further reducing the rigidity of the bottom portion. Therefore, even when an internal pressure of the packaging container is changed relative to an external pressure, change in pressure can be reduced by expanding or recessing the bottom portion, and the design such as an outer appearance of the packaging container may not be degraded. In particular, in a case where the center portion of the bottom portion is previously expanded outward of the packaging container, even when an internal pressure of the packaging container which is filled with contents and in which the contents are packaged is reduced as compared to an external pressure, reduction in pressure in the container can be reduced by the bottom portion having a relatively low rigidity being recessed toward the inside of the packaging container. Therefore, the side surface portion or the like of the packaging container is not recessed and the design such as an outer appearance of the side surface portion and the like may not be degraded. Further, a non-sealed portion is formed in the upper end portion of the fixing portion that is an outer edge portion of a bottom member forming the bottom portion. In this case, concentration of stress near the outer edge portion of the bottom portion in the case of the bottom portion being recessed inward is prevented, and no crinkling occurs near the outer edge portion, to prevent design of the bottom portion from being degraded.

DESCRIPTION OF EMBODIMENTS

<1. Structure of Packaging Container>

Figure 1:
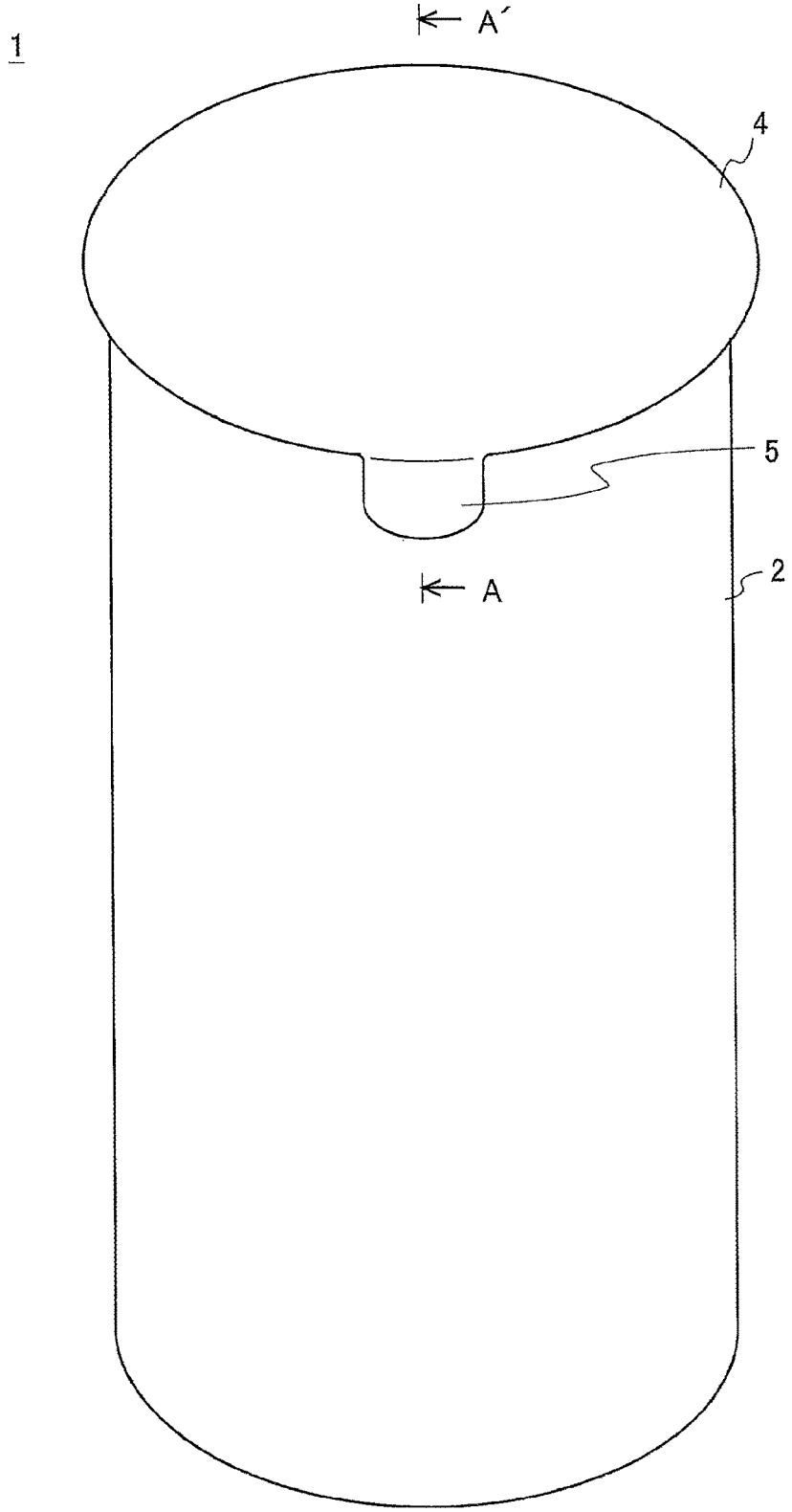
FIG. 1 is a perspective view of a packaging container according to an embodiment.
Figure 2:
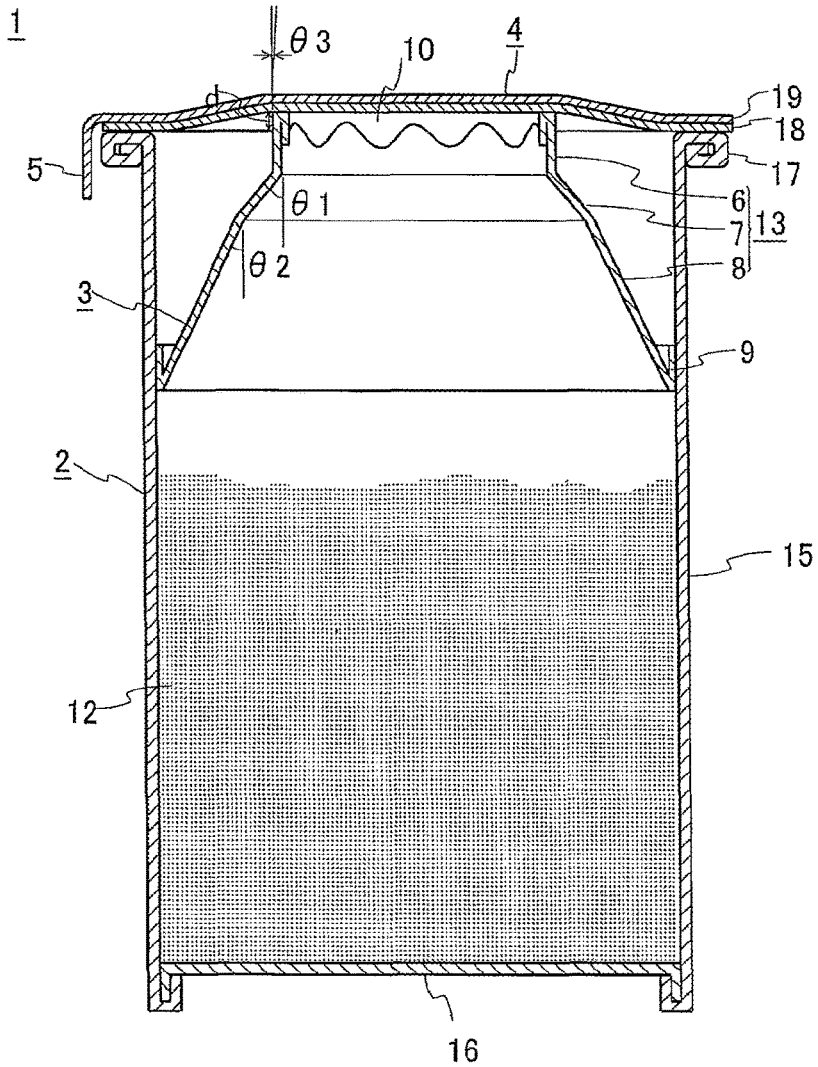
FIG. 2 is a cross-sectional view as taken along a line A-A' shown in FIG. 1.
Figure 3:
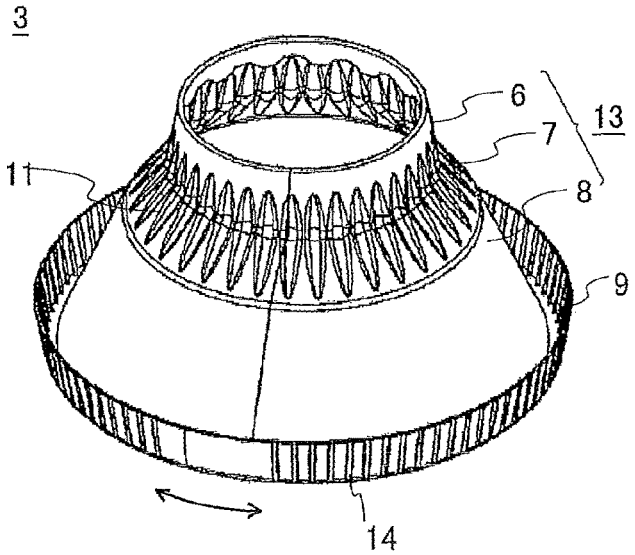
FIG. 3 is a perspective view of a funnel component shown in FIG. 2. according to the embodiment is used.

FIG. 1 is a perspective view of a packaging container according to an embodiment. FIG. 2 is a cross-sectional view as taken along a line A-A' shown in FIG. 1. FIG. 3 is a perspective view of a funnel component shown in FIG. 2.

The packaging container 1 allows fluid contents such as powdery, granular, and liquid contents including, for example, foods like instant coffee and powder milk, and toner for copy machines and laser printers to be packaged, and allows facilitation of transfer of the contents to a storage container or the like. The packaging container 1 includes a cup-shaped container body 2, a funnel component 3 fitted into the container body 2, and a sealing lid 4.

The container body 2 includes a cylindrical side wall 15 and a bottom portion 16. One end portion of a cylindrical portion formed by the side wall 15 is closed by the bottom portion 16, and the other end portion is open. In the open end portion of the container body 2, a flange portion 17 is formed by an edge portion of the side wall 15 being curled outward, and being then squeezed and flattened. The container body 2 is formed of a material including paper as a main component, in consideration of reduction in weight of the container, facilitation of disposal, and resource saving. For example, a laminated film formed by paper and resin may be used. When gas barrier property is required, a gas barrier layer, such as a deposition film, an aluminium foil, or the like, is included in the laminated structure. A manufacturing method for manufacturing the container body 2 will be described below in detail.

The funnel component 3 includes: a funnel portion 13 having its diameter reduced from a wide opening portion toward a narrow opening portion; and a side wall portion 9 that surrounds an outer surface of the funnel portion 13 and connects to the wide opening portion of the funnel portion 13. The funnel component 3 is integrally formed by using a material that includes paper as a main component. As a material of the funnel component 3, a laminated sheet formed of paper and polyethylene can be advantageously used. A manufacturing method for manufacturing the funnel component 3 will be described below in detail.

The funnel portion 13 includes: a discharge portion 6 forming the narrow opening portion; a first tapered portion 7 that connects to the discharge portion 6; and a second tapered portion 8 that connects to the first tapered portion 7 and forms the wide opening portion. A taper angle θ1 of the first tapered portion 7 is designed so as to be greater than a taper angle θ2 of the second tapered portion 8. The discharge portion 6 may be formed so as to extend straight such that its diameter is almost uniform, or so as to be tapered with a taper angle θ3. In order to unseal the packaging container 1, a pressing force is applied to the discharge portion 6 through the sealing lid 4. Therefore, in order to enhance strength against buckling, the discharge portion 6 is ideally designed so as to extend straight (namely, so as to satisfy the taper angle θ3=0°. However, in order to improve efficiency of removal from a mold in the molding, the taper angle θ3 is preferably set as a value that is greater than 0°, and less than or equal to 15°. In this range, the taper angle θ3 is more preferably set so as to range from 5° to 10°. The greater the taper angle θ3 is, the more advantageous the efficiency of removal from a mold in the molding is. However, when the taper angle θ3 is greater than 15°, strength of the discharge portion 6 is reduced.

Further, a folded portion 10 is formed inside the discharge portion 6 by a portion of a sheet member being folded back inward. The folded portion 10 is attached to an inner surface of the discharge portion 6 by heat-sealing, and serves to reinforce the narrow opening portion of the funnel component 3. An edge of the folded portion 10 is corrugated such that a tensile force applied to the sheet member is reduced to prevent breakage of the sheet member when the sheet member is folded back to form the folded portion 10.

Through the side wall portion 9, the funnel component 3 is welded to an inner circumferential wall of the container body 2. As shown in FIG. 3, the side wall portion 9 has a plurality of creases 14 that extend in the axial direction of the funnel component 3 in a range other than a portion (a range indicated by arrows) in which the sheet member is layered. The creases 14 allow the side wall portion 9 to be stretchable. Instead of the creases 14, a plurality of ruled lines may be formed, an embossing process may be performed on the side wall portion 9, or the side wall portion 9 may be corrugated so as to alternately increase and reduce distances from the side wall portion 9 to the center axis of the funnel component 3, thereby allowing the side wall portion 9 to be stretchable.

The funnel component 3 is inserted into the container body 2 such that the wide opening portion is caused to face the bottom portion 16, and the outer surface of the side wall portion 9 is welded to the inner circumferential surface of the container body 2, thereby fixing the funnel component 3 to the container body 2. A position at which the funnel component 3 is attached, is adjusted such that an end portion of the discharge portion 6 projects outward of a plane including an open end of the container body 2. Thus, when the discharge portion 6 of the funnel component 3 projects from the plane including the open end of the container body, adhesiveness between the funnel component 3 and the sealing lid 4 is enhanced, and the contents can be prevented from passing between the narrow opening side end portion of the funnel component 3 and the sealing lid 4 and moving outward of the funnel component 3. A projection d of the funnel component 3 is set so as to be greater than 0 mm, and less than or equal to 2 mm. In this range, when the projection d of the narrow opening portion is greater than or equal to 0.5 mm, and not greater than 1.5 mm, positioning of the funnel component 3 relative to the container body 2 is facilitated, and manufacturing of the packaging container 1 is facilitated.

The sealing lid 4 includes: a lower film 18 with which the flange portion 17 of the container body 2 is sealed; and an upper film 19 that is layered over an outer surface of the lower film 18 so as to be separable. The lower film 18 has not-illustrated perforation lines that radially extend, and is broken by a pressing force being applied from a container to be filled when used. The upper film 19 is provided so as to protect the perforation lines formed in the lower film 18, and assuredly hermetically seal the packaging container 1, and is separated from the lower film 18 when used. A tab 5 is formed in a portion of an outer circumferential edge of the upper film 19 so as to facilitate handling when the upper film 19 is separated from the lower film 18.

Figure 4:
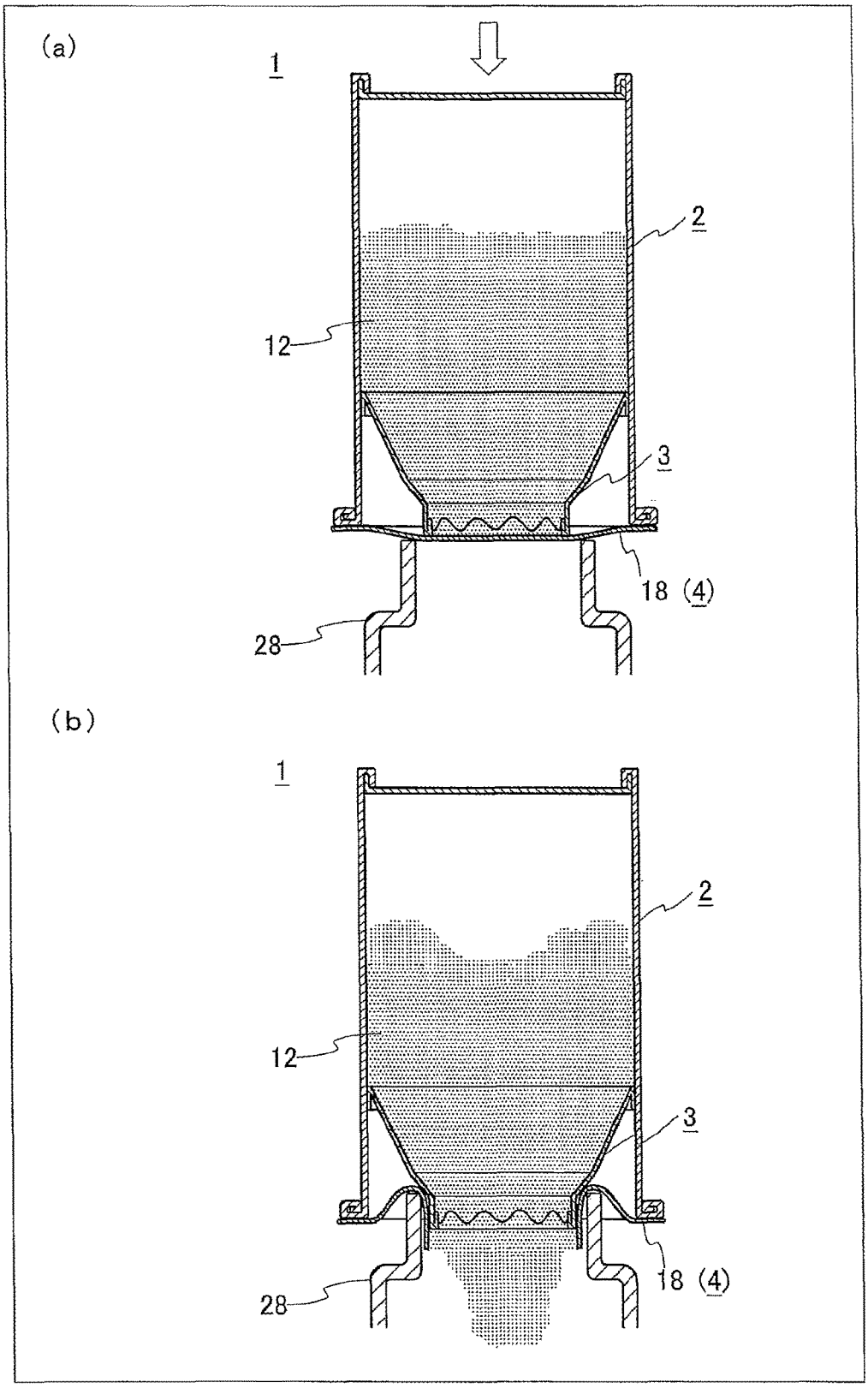
FIG. 4 is a cross-sectional view illustrating a state where a packaging container according to the embodiment is used.

FIG. 4 is a cross-sectional view illustrating a state where the packaging container according to the present embodiment is used.

When the packaging container 1 is used, the upper film 19 of the sealing lid 4 is separated as shown in (a) of FIG. 4, and the packaging container 1 is turned upside down, to place the lower film 18 of the sealing lid 4 so as to contact with an opening of a container 28, such as a storage container or a tank, to be filled. The packaging container is pressed toward the container 28 to be filled, to break the lower film 18 of the sealing lid 4 as shown in (b) of FIG. 4. When the lower film 18 is broken, contents 80 flow along the inner surface of the funnel component 3 into the container to be filled. With the packaging container 1 having such a structure, an operator is allowed to easily refill the container to be filled, with the contents 80 without making an operator's hand or a working place unclean.

The funnel component 3 has a cushioning property since the funnel component 3 includes the first tapered portion 7 and the second tapered portion 8 having different taper angles, respectively. A pressing force applied to the discharge portion 6 during unsealing ((a) of FIG. 4), transportation, or the like, is absorbed due to elastic deformation occurring near a boundary between the first tapered portion 7 and the second tapered portion 8, and near a boundary between the first tapered portion 7 and the discharge portion 6. Therefore, buckling and deformation of the funnel component 3 can be effectively reduced.

<2. Manufacturing Method for Manufacturing Packaging Container>

Figure 5:
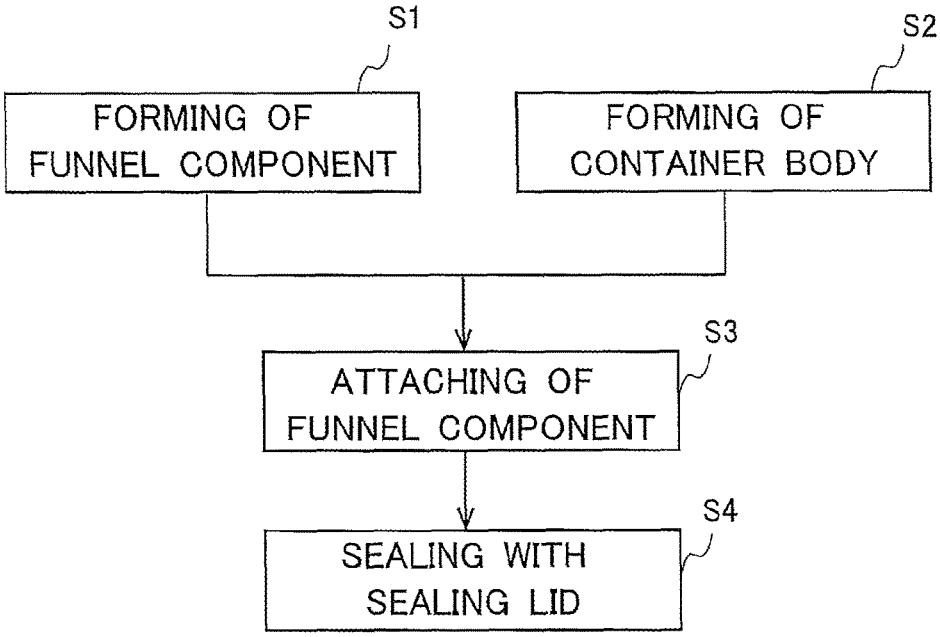
FIG. 5 is a flow chart showing a manufacturing method for manufacturing the packaging container according to the embodiment.

FIG. 5 is a flow chart showing a manufacturing method for manufacturing the packaging container according to the embodiment.

The manufacturing method for manufacturing the packaging container according to the present embodiment includes a step S1 of forming the funnel component 3, a step S2 of forming the container body 2, a step S3 of attaching the funnel component 3 to the container body 2, and a step S4 of sealing the open end of the container body 2 with the sealing lid 4. Either one of the step S1 of forming the funnel component 3 and the step S2 of forming the container body 2 may be performed earlier. Further, the packaging container 1 is filled with the contents 80 after the step S3 of attaching the funnel component before the step S4 of sealing with the sealing lid. Hereinafter, the manufacturing method will be described in detail.

<3. Manufacturing Method for Manufacturing Funnel Component>

FIGS. 6A to 6E illustrate a manufacturing process for the funnel component shown in FIG. 3.

Figure 6A:
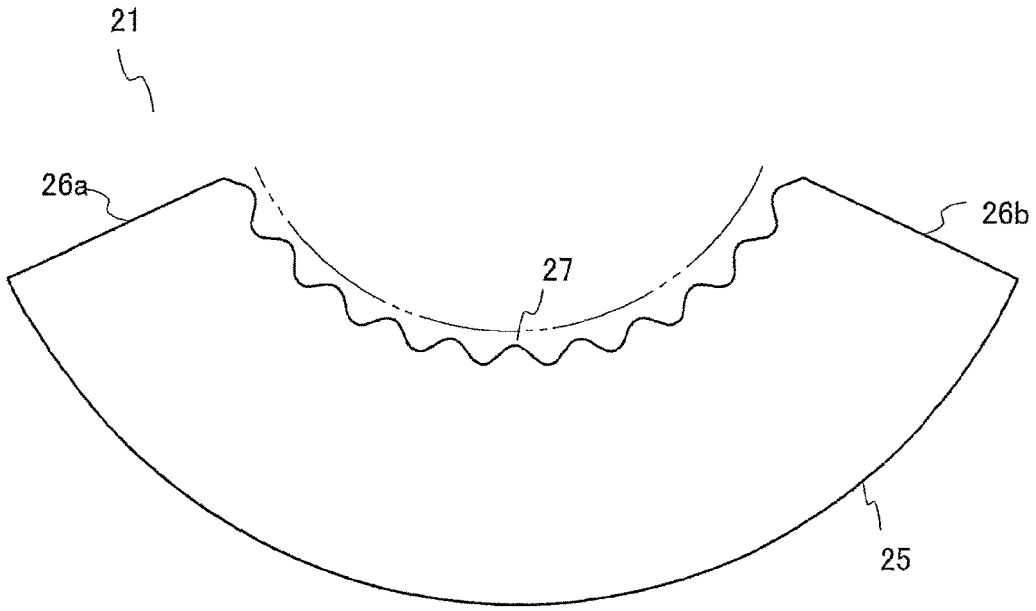
FIG. 6A illustrates a manufacturing process for the funnel component shown in FIG. 3.

Firstly, a sheet member including paper as a main component is punched by using a die, to produce a blank material 21 shown in FIG. 6A. The blank material 21 has such a shape that a portion of a sector is cut out. More specifically, the blank material 21 has a shape that is surrounded by an arc 25, two straight lines 26*a* and 26*b* that extend in the radial direction of the arc, and a corrugated line portion 27 that extends along an arc (virtually indicated by an alternate long and two short dashes line in FIG. 6A) that is concentric with the arc 25 and has a radius less than the arc 25. As a material of the blank material 21, a sheet member having, for example, a laminated structure of polyethylene/paper/polyethylene, is advantageously used.

Figure 6B:
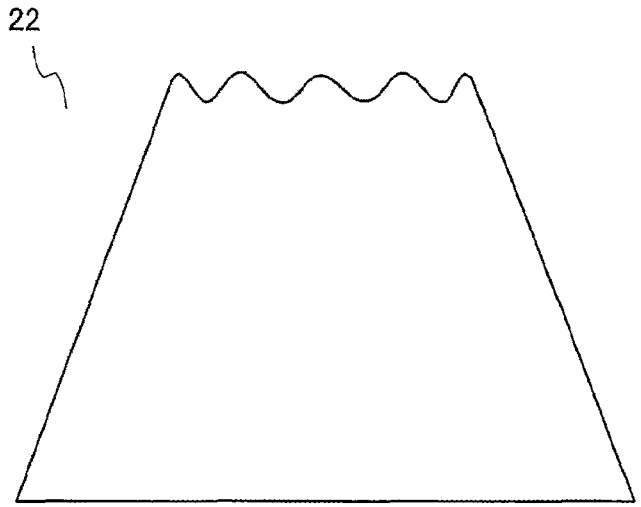
FIG. 6B illustrates a manufacturing process subsequent to the process shown in FIG. 6A.

Next, an intermediate product 22 is formed so as to be shaped into almost a circular truncated cone shown in FIG. 6B. More specifically, the blank material 21 is wound around a mandrel in a circular truncated cone shape, and portions near the straight lines 26*a* and 26*b* are caused to overlap each other, to heat-seal the overlapping portion, thereby obtaining the intermediate product 22.

Figure 6C:
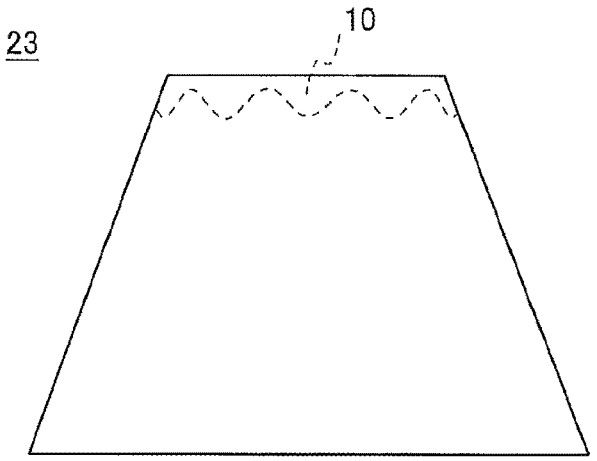
FIG. 6C illustrates a manufacturing process subsequent to the process shown in FIG. 6B.

Next, a narrow open portion of the intermediate product 22 is folded back inward, to form an intermediate product 23 shown in FIG. 6C. More specifically, firstly, an inner surface of the narrow open portion of the intermediate product 22 is heated by hot air or the like to melt a sealant. Next, a fluid paraffin is applied to the outer surface of the narrow open portion. Then, the narrow open portion is folded back inward by using a mold, and the folded portion is sealed to an inner surface of the tapered portion, to form the folded portion 10. After the narrow open portion of the intermediate product 22 is folded back, the overlapping portion may be heated and sealed. The fluid paraffin is used in order to prevent breakage of the folded portion of the intermediate product 22, and enhance efficiency of removal from a mold or the like. Although the fluid paraffin is preferably applied, no fluid paraffin may be applied.

Figure 6D:
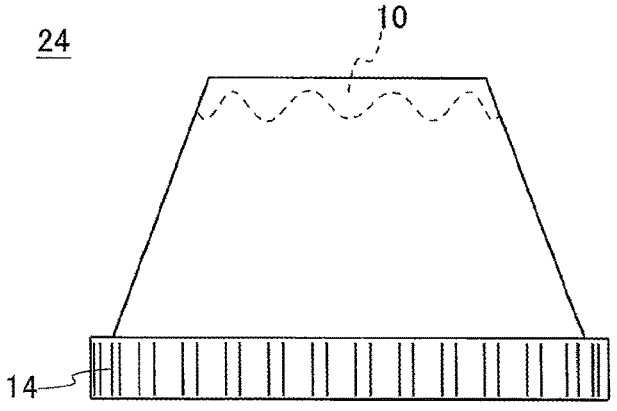
FIG. 6D illustrates a manufacturing process subsequent to the process shown in FIG. 6C.

Next, a fluid paraffin is applied to the wide open portion of the intermediate product 23, and the wide open portion is folded back outward, to form an intermediate product 24 shown in FIG. 6D. At this time, a mold having concave and convex portions at a position corresponding to the side wall portion 9 is used to form the side wall portion 9, and simultaneously form the creases 14 in the side wall portion 9, thereby contracting the side wall portion 9 in the circumferential direction. Further, the mold is heated to about 40° C., to maintain the side wall portion 9 in a contracted state, thereby preventing the creases 14 of the side wall portion 9 from being unfolded after the molding. Instead of the creases 14, ruled lines may be formed in the blank material, and the ruled line portions may be contracted, to allow the side wall portion 9 to be stretchable. Further, for example, a plurality of recesses may be formed so as to extend in the axial direction of the intermediate product 23 by embossing process, or the side wall portion 9 may be molded so as to be corrugated such that distances from the axis center of the intermediate product 23 are increased and reduced, thereby allowing the side wall portion 9 to be stretchable. Also in this step, the fluid paraffin is used to prevent breakage of the folded portion of the intermediate product 24 and enhance efficiency of removal from a mold or the like. Although the fluid paraffin is preferably applied, no fluid paraffin may be applied.

Figure 6E:
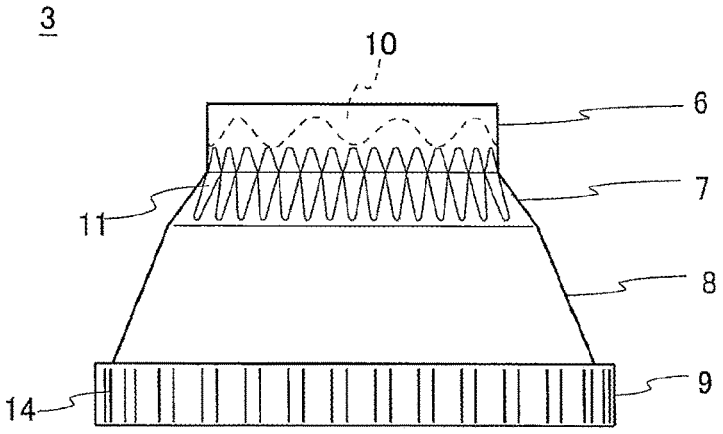
FIG. 6E illustrates a manufacturing process subsequent to the process shown in FIG. 6D.

Next, by using a mold heated to about 65° C., the intermediate product 24 is subjected to press forming, to simultaneously form the discharge portion 6, the first tapered portion 7, and the second tapered portion 8 as shown in FIG. 6E. During the press forming, a plurality of embossed portions 11 that extend in the axial direction of the funnel component 3 are formed over a boundary between the discharge portion 6 and the first tapered portion 7. The embossed portions 11 can serve to reduce crinkling in the boundary portion between the discharge portion 6 and the first tapered portion 7. The discharge portion 6, the first tapered portion 7, and the second tapered portion 8 may be formed by drawing process before the side wall portion 9 is formed.

A reason why the narrow open side edge of the intermediate product 22 is cut so as to be corrugated will be described.

Figure 7:
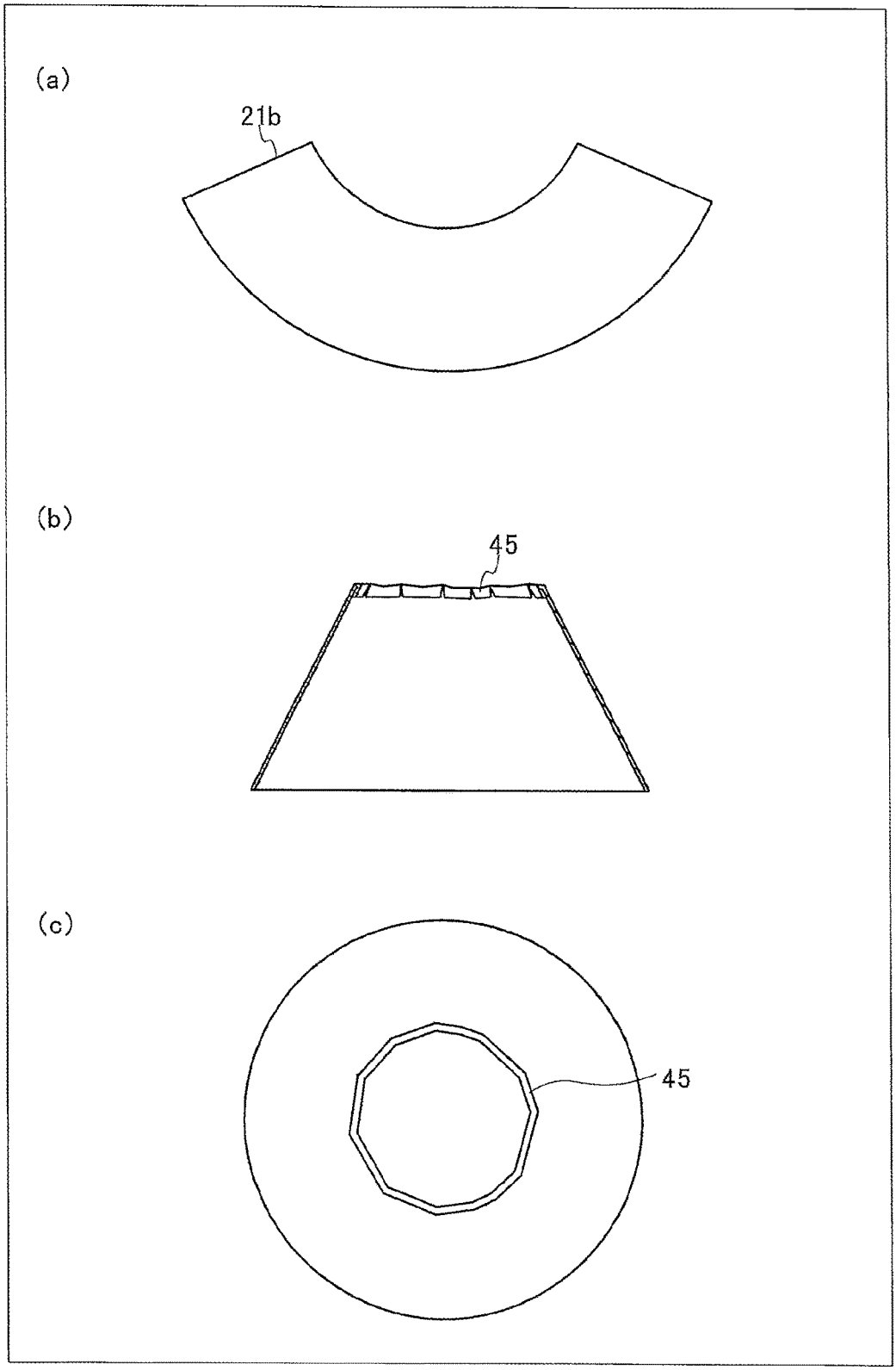
FIG. 7 illustrates a state where a narrow open side edge of an intermediate product is broken during folding-back.

(a) of FIG. 7 is a top view of a blank material 21*b* having a narrow open side edge that is not cut so as to be corrugated, and (b) and (c) of FIG. 7 are a cross-sectional view and a top view illustrating a state where an intermediate product produced by using the blank material 21*b* is broken when the narrow open side edge is folded back.

In a case where a narrow open portion of an intermediate product having a tapered shape is folded back, when the taper angle of the intermediate product 22 shown in FIG. 6B is approximately greater than or equal to 10°, a difference between a circumferential length of the folding portion and a circumferential length of a portion near the edge of the sheet member is increased, and the difference cannot be absorbed by extension of the sheet member. Therefore, when the blank material 21*b*, as shown in (a) of FIG. 7, having the narrow open side edge that is not cut so as to be corrugated is used, a high tensile force in the circumferential direction is generated in the edge portion of a folded portion 45 during the folding-back, to break the folded portion 45 as shown in (b) of FIG. 7. When the folded portion 45 is broken, the broken portion is more likely to be broken as compared to other portions. Therefore, the narrow opening portion has a polygonal shape and the outer appearance thereof is poor as shown in (c) of FIG. 7. Further, when the narrow opening portion has a polygonal shape, problems in functions arise that, for example, after sealing with a sealing lid is performed, a gap may be generated between the sealing lid and the narrow opening portion, or deformation is more likely to occur due to a strength being reduced.

On the other hand, when the narrow open side edge of the intermediate product 22 is cut so as to be corrugated as shown in FIG. 6B, by using, for example, the blank material 21 having the narrow open side edge that is cut so as to be corrugated as shown in FIG. 6A, peak portions of the corrugated line are allowed to be extended in the folding-back, and the narrow open portion of the intermediate product 22 can be thus prevented from being broken in the folding-back. Further, high resisting force is not applied to an inward curling die used for forming the folded portion 10, from the edge of the folded portion 10, whereby the folding-back process can be performed with low pressing pressure. Therefore, usage of the fluid paraffin for enhancing slidability of a mold and a sheet member can be reduced or eliminated.

Figure 8:
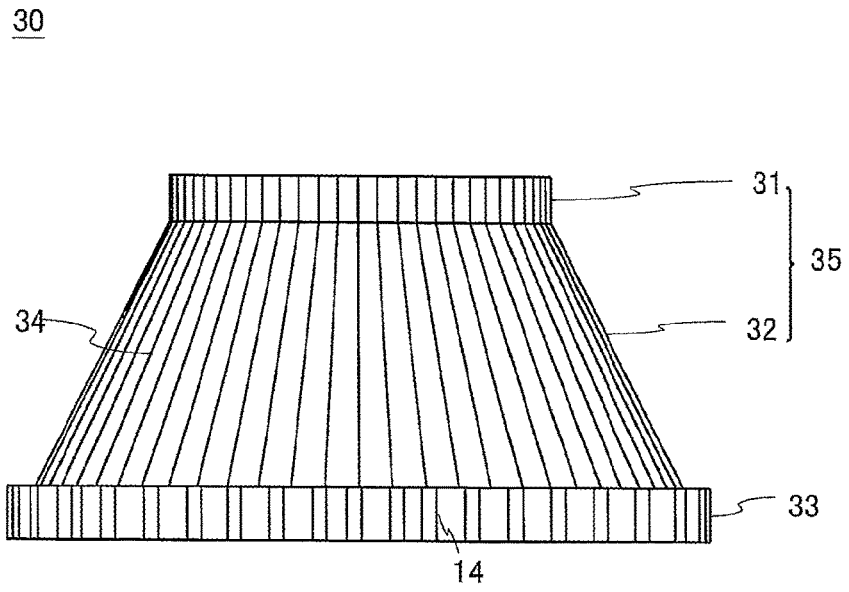
FIG. 8 is a front view of another exemplary funnel component.

FIG. 8 is a front view of another exemplary funnel component. In a funnel component 30 shown in FIG. 8, the shape of a funnel portion 35 is different from that of the funnel component 3 shown in FIG. 3.

The funnel component 30 includes: the funnel portion 35 having its diameter reduced from the wide opening portion toward the narrow opening portion; and a side wall portion 33 that surrounds the outer surface of the funnel portion 35 and connects to the wide opening portion of the funnel portion 35. The funnel component 30 is also integrally formed by using a material that includes paper as a main component. As a material by which the funnel component 30 is formed, a laminated sheet formed by paper and polyethylene can be advantageously used.

The funnel portion 35 includes: a discharge portion 31 forming the narrow opening portion; and a tapered portion 32 that connects to the discharge portion 31. A folded portion (not shown) is formed, inside the discharge portion 31, by a portion of a sheet member being folded back inward and sealed, in order to reinforce the narrow opening portion of the funnel component 30.

Through the side wall portion 33, the funnel component 30 is welded to an inner surface of the container body 2. The side wall portion 33 has a plurality of creases 14 that extend in the axial direction of the funnel component 30. The creases 14 allow the side wall portion 33 to be stretchable. Instead of the creases 14, ruled lines may be formed in a blank material to contract the ruled line portion, to allow the side wall portion 33 to be stretchable. Alternatively, for example, an embossing process may be performed to form a plurality of recesses that extend in the axial direction of the funnel component 30, or the side wall portion 33 may be molded so as to be corrugated such that distances from the axis center of the funnel component 30 are increased and reduced, thereby allowing the side wall portion 33 to be stretchable.

FIGS. 9A to 9D illustrate a manufacturing process for the funnel component shown in FIG. 8. FIG. 10 is a cross-sectional view of a ruled line portion obtained before and after a drawing process.

Figure 9A:
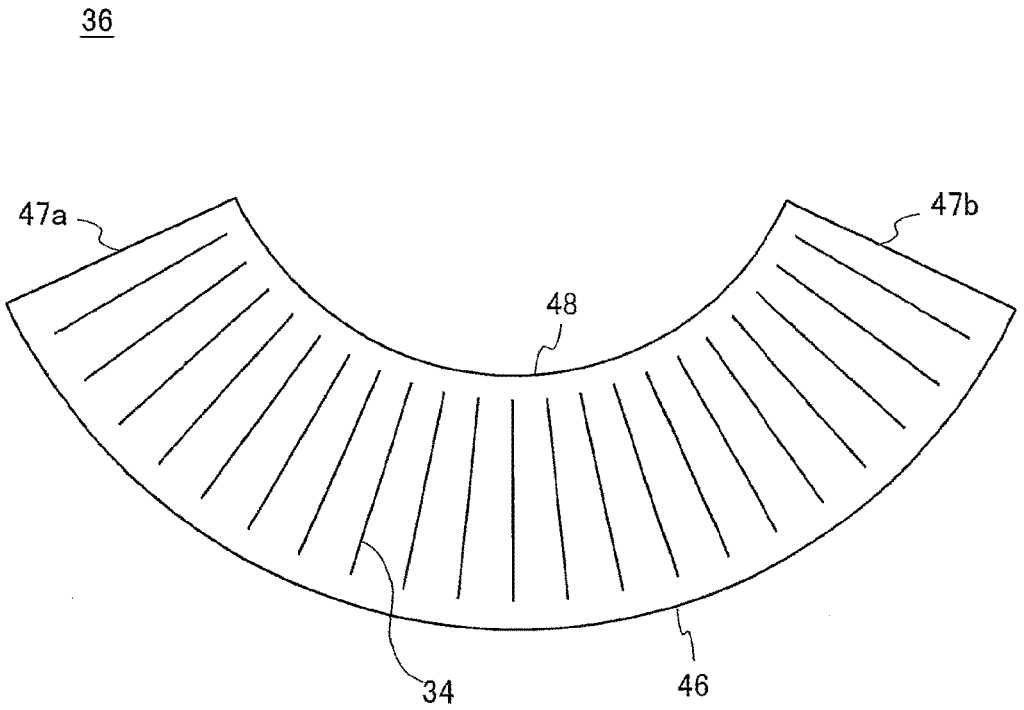
FIG. 9A illustrates a manufacturing process for the funnel component shown in FIG. 8.
Figure 10:
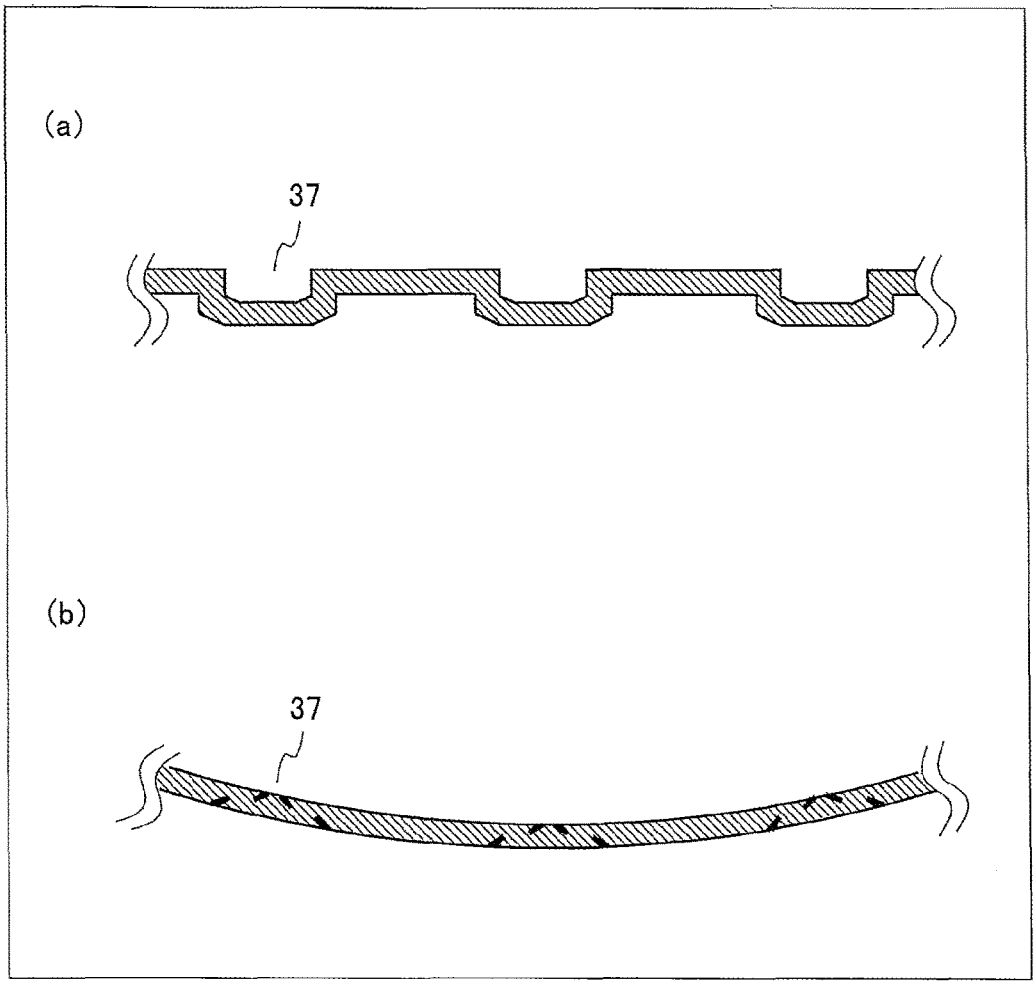
FIG. 10 is a cross-sectional view of a ruled line portion obtained before and after pressing process.

Firstly, a sheet member that includes paper as a main component is punched by using a die, to produce a blank material 36 shown in FIG. 9A. The blank material 36 has such a shape that a portion of a sector is cut out. More specifically, the blank material 36 has a shape that is surrounded by an arc 46, two straight lines 47*a* and 47*b* that extend in the radial direction of the arc 46, and an arc 48 having a radius less than the arc 46. As a material of the blank material 36, a sheet member having, for example, a laminated structure of polyethylene/paper/polyethylene is advantageously used. Further, the blank material 36 has a plurality of ruled lines 34 that extend in the radial direction of the arc 46.

Figure 9B:
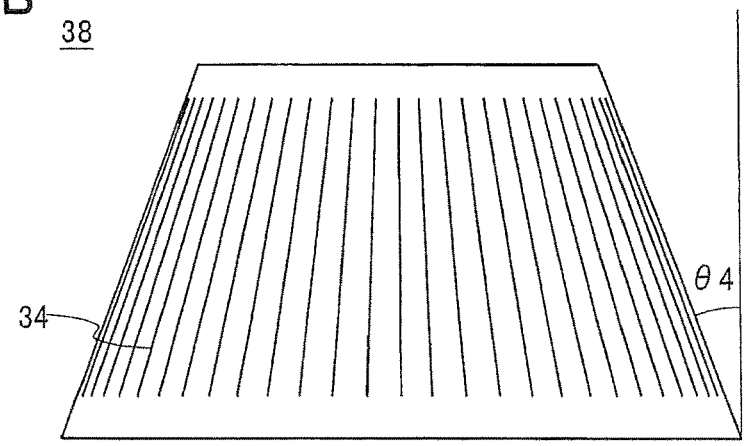
FIG. 9B illustrates a manufacturing process subsequent to the process shown in FIG. 9A.

Next, the blank material 36 is wound around a mandrel in a circular truncated cone shape, and portions near the straight lines 47*a* and 47*b* are caused to overlap each other, to heat-seal the overlapping portion, thereby obtaining an intermediate product 38 in almost a circular truncated cone shape shown in FIG. 9B.

Figure 9C:
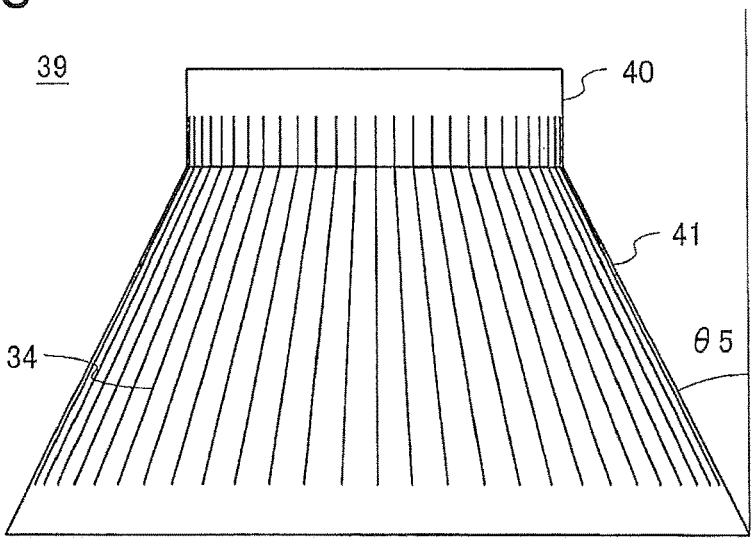
FIG. 9C illustrates a manufacturing process subsequent to the process shown in FIG. 9B.

Next, pressing process is performed by using a heated mold, to form an intermediate product 39 shown in FIG. 9C. More specifically, drawing process is performed on the narrow open portion of the intermediate product 38 shown in FIG. 9B, to form a narrow open portion 40 and a tapered portion 41 that connects to the narrow open portion 40. At this time, a taper angle θ5 of the tapered portion 41 becomes greater than a taper angle θ4 of the intermediate product 38. Further, in the pressing process for forming the intermediate product 39, portions near the ruled lines 37 shown in (a) of FIG. 10 are welded in a squeezed state as shown in (b) of FIG. 10. Thus, the sheet member is pressed and hardened so as to fill the recesses formed by the ruled lines 37, thereby enhancing strength of the entirety of the funnel component.

Figure 9D:
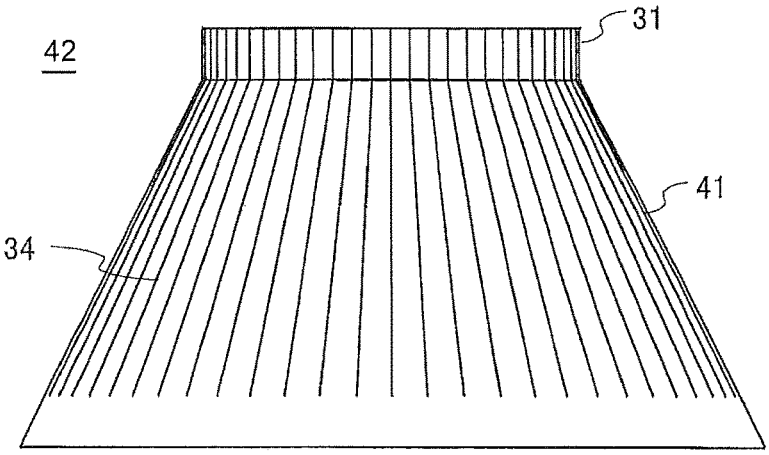
FIG. 9D illustrates a manufacturing process subsequent to the process shown in FIG. 9C.

Next, the narrow open portion of the intermediate product 39 is folded back inward, to form an intermediate product 42 shown in FIG. 9D. More specifically, firstly, an inner surface of the narrow open portion of the intermediate product 39 is heated by hot air or the like, to melt a sealant. Next, a fluid paraffin is applied to the outer surface of the narrow open portion, the narrow open portion is folded back inward by using a mold, and the folded portion is sealed to the inner surface of the discharge portion 31. As shown in FIG. 9C, although the narrow open side edge is not cut so as to be corrugated, the narrow open side portion is subjected to a drawing process in advance such that the narrow open side portion becomes straight or the narrow open side portion is tapered with a very small taper angle. Therefore, an excess tensile force is not applied to the folded portion in the folding-back, and the sheet member is less likely to be broken.

The fluid paraffin is applied to the wide open portion of the intermediate product 42, and the wide open portion is folded back outward, to form the side wall portion 33 shown in FIG. 8. At this time, a mold having concave and convex portions at a position corresponding to the side wall portion 33 is used to form the side wall portion 33, and simultaneously form the creases 14 in the side wall portion 33, thereby contracting the side wall portion 33 in the circumferential direction. Further, the mold is heated to about 40° C., to maintain the side wall portion 33 in a contracted state and prevent the creases 14 of the side wall portion 33 from being unfolded after the molding. Through the above steps, the funnel component 30 shown in FIG. 8 is completed. The side wall portion 33 may be formed before the narrow open portion is folded back.

As described above, in the manufacturing method according to the present embodiment, a sheet member that includes paper as a main component is used to produce an intermediate product in almost a circular truncated cone shape, and the intermediate product is pressed and molded to manufacture a funnel component having practical strength at low cost.

<4. Manufacturing Method for Manufacturing Container Body>

FIGS. 11A to 11D illustrate a manufacturing method for manufacturing the container body shown in FIG. 2.

Figure 11A:
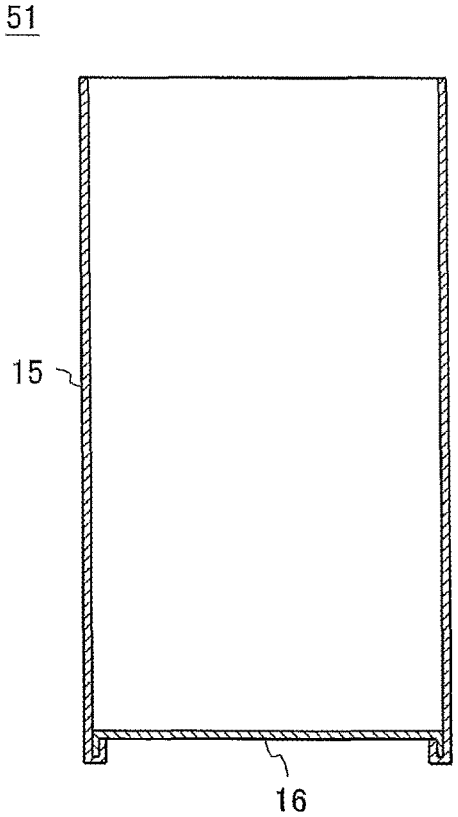
FIG. 11A is a cross-sectional view illustrating a manufacturing method for manufacturing a container body shown in FIG. 2.

Firstly, a cup-shaped intermediate product 51 shown in FIG. 11A is formed. Specifically, a rectangular sheet member is wound around a circumferential wall surface of a cylindrical mandrel to cause edge portions to overlap each other, and the overlapping portion is heat-sealed to from a cylindrical intermediate product. Subsequently, in one end portion of the cylindrical intermediate product, an outer circumferential edge portion of a circular bottom member is sandwiched and sealed, to form the intermediate product 51 shown in FIG. 11A. As a material by which the side wall 15 is formed, a sheet member having a laminated structure of polyethylene/paper/polyethylene terephthalate/polyethylene, or a sheet member having a laminated structure of polyethylene/paper/aluminium/polyethylene can be used.

Figure 11B:
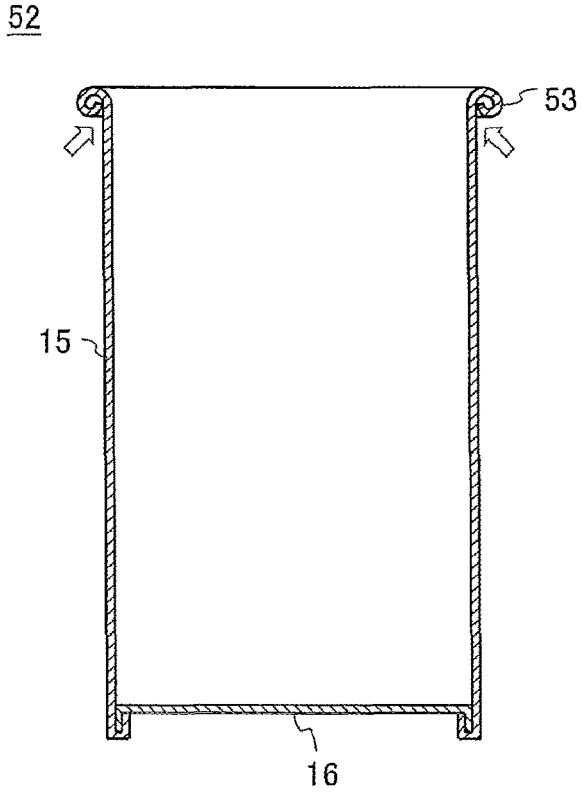
FIG. 11B illustrates a manufacturing process subsequent to the process shown in FIG. 11A.

Next, an intermediate product 52 shown in FIG. 11B is formed. Specifically, a fluid paraffin is applied to the open end portion of the intermediate product 51, and thereafter a curling die is used to curl the open end portion outward by about one turn, to form a curling portion 53 in the open end portion.

Figure 11C:
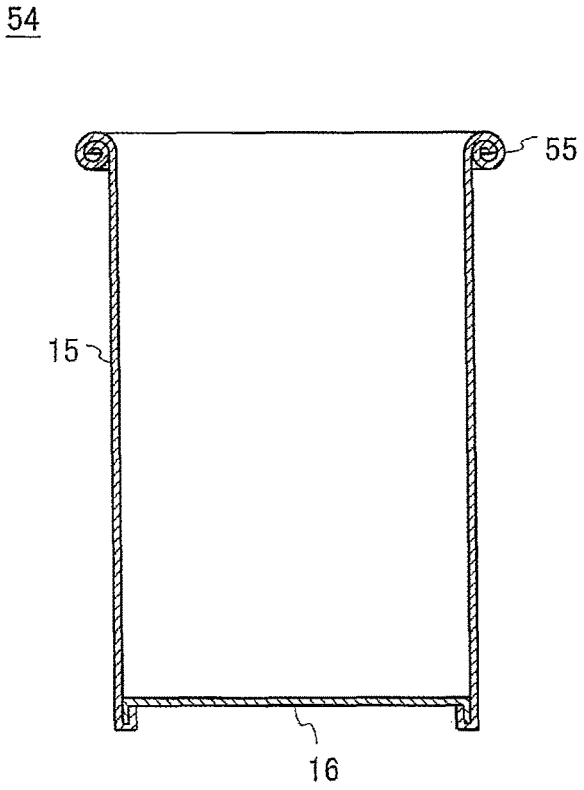
FIG. 11C illustrates a manufacturing process subsequent to the process shown in FIG. 11B.

Next, an intermediate product 54 shown in FIG. 11C is formed. Specifically, a lower portion of the curling portion 53 and a portion of the side wall 15 near the curling portion 53 of the intermediate product 52 (a portion indicated by an arrow in FIG. 11B) are heated by hot air or the like to melt a sealant, and thereafter the curling portion 53 is further curled outward to form a curling portion 55 shown in FIG. 11C. The curling portion 55 is formed by the open end portion of the side wall 15 being curled by 1.5 or more turns. Further, a fluid paraffin is preferably applied to the die for forming the curling portion 55 in advance.

Figure 11D:
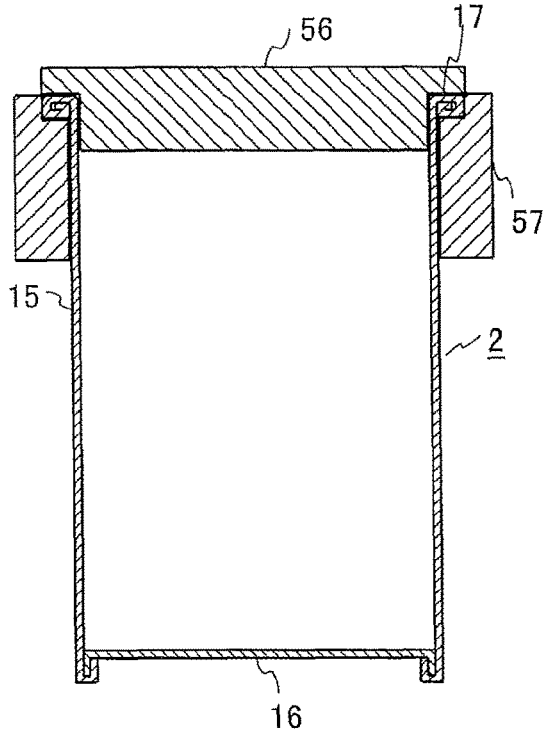
FIG. 11D illustrates a manufacturing process subsequent to the process shown in FIG. 11C.

As shown in FIG. 11D, molds 56 and 57 are used to sandwich and squeeze the curling portion 55 from thereabove and therebelow, to form the flange portion 17. Through the above steps, the container body 2 is completed.

As a conventional method for forming the flange portion 17, a method in which a curling portion having been formed is sandwiched and squeezed between an ultrasonic horn and a receiving mold, to perform ultrasonic welding of the squeezed portion, or a method in which a curling portion is formed while heating is being performed, to perform heat-pressing for the curling portion by using a die, has been used. However, in the former method, a problem arises that pressure is concentrated on a relatively thick portion to cause scorching. In particular, when the thickness of the sheet member is greater than or equal to 0.4 mm, the problem is significant. Further, in the latter method, a problem arises that buckling and crinkling occurs in a flange portion and a side wall in the pressing process due to slidability of the heated sheet member being reduced, and products cannot be manufactured.

In the manufacturing method for manufacturing the container body 2 according to the present embodiment, by a sealant being heated and melted in advance during forming of the curling portion 55, the curling portion 55 is merely squeezed to sufficiently weld the squeezed portion, and buckling and crinkling in the flange portion and the side wall can be prevented, thereby forming the flange portion 17 having a flat top surface. Further, in the manufacturing method according to the present embodiment, even when the thickness of the sheet member is about 0.45 mm, the flange portion 17 can be formed.

In the present embodiment, the curling portion 53 is formed by the open end portion being wound outward by about one turn, and the curling portion 53 is heated and is further wound by about 0.5 turns, to from the curling portion 55 obtained by the open end portion being wound outward by about 1.5 turns. The winding amount described herein is merely an example, and the present embodiment is not limited to this example. The winding amount for the curling portions 53 and 55 may be set such that a portion of the sealant of the curling portion 53 formed in the earliest formation of the curling portion can be heated and melted, and the sealant that has been melted can be wound and welded in the curling portion 55 in the subsequent formation of the curling portion.

<5. Method for Attaching Funnel Component>

Figure 12A:
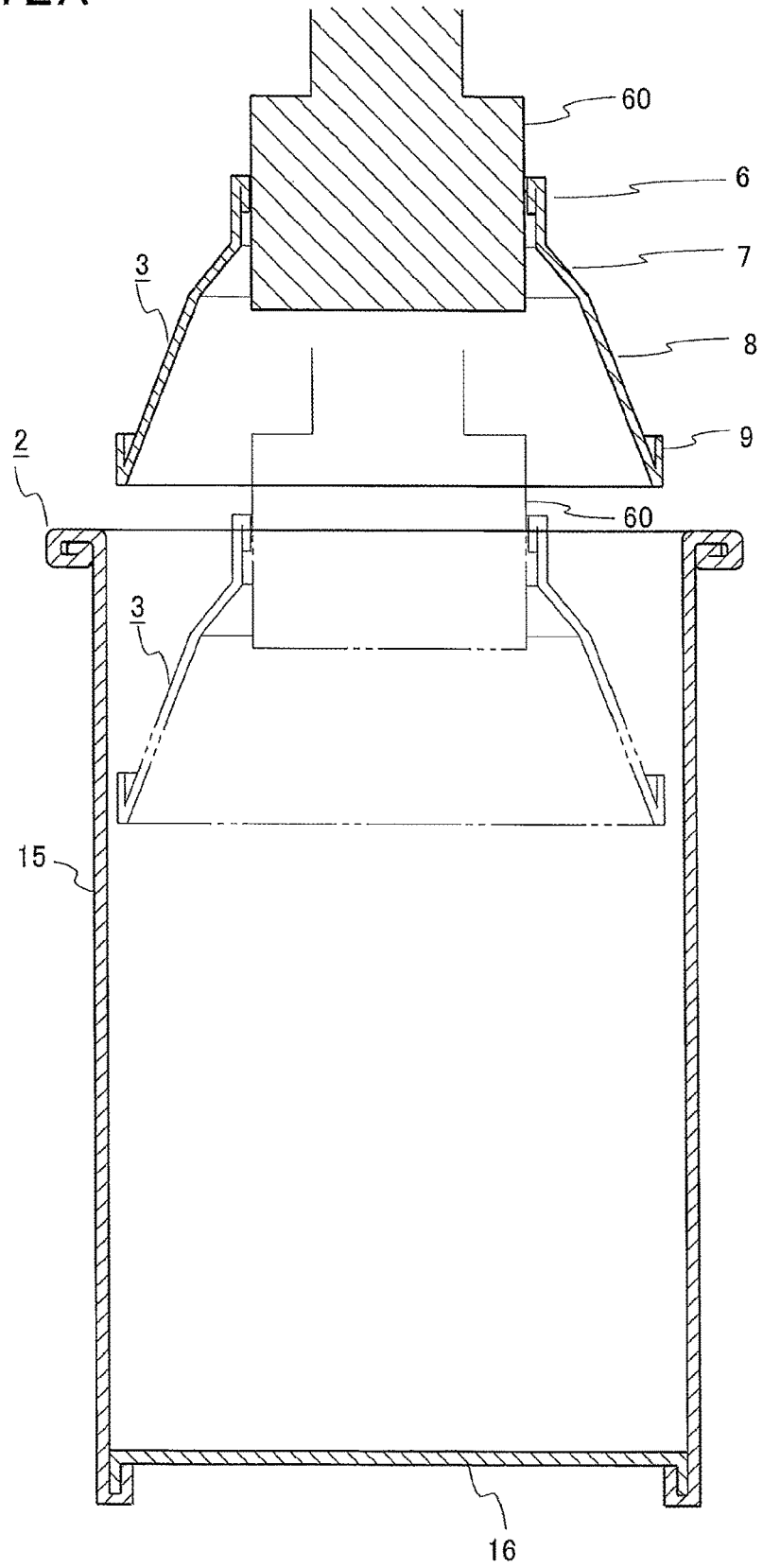
FIG. 12A is a cross-sectional view illustrating a method for attaching the funnel component to the container body.
Figure 12B:
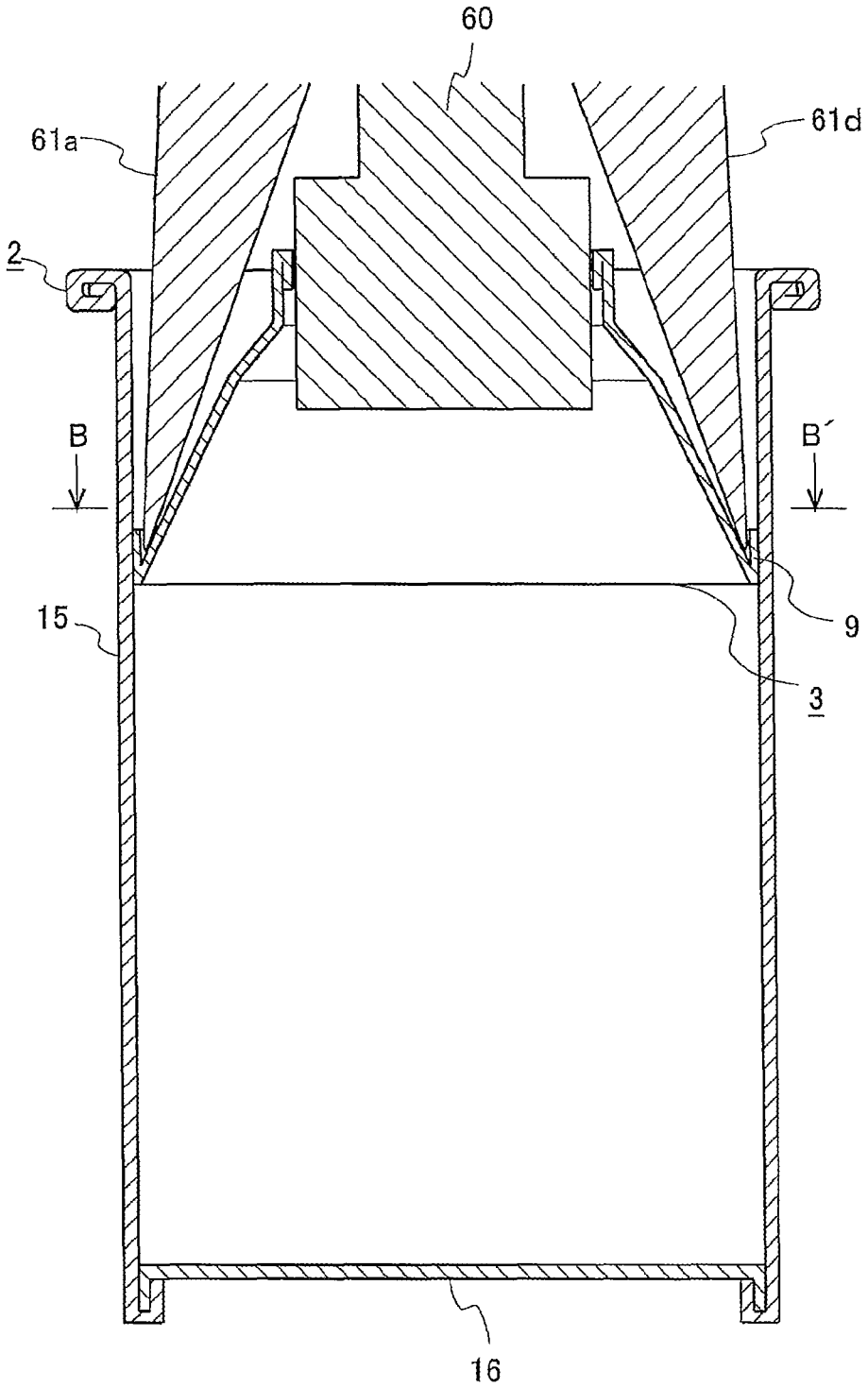
FIG. 12B illustrates a manufacturing process subsequent to the process shown in FIG. 12A.
Figure 12C:
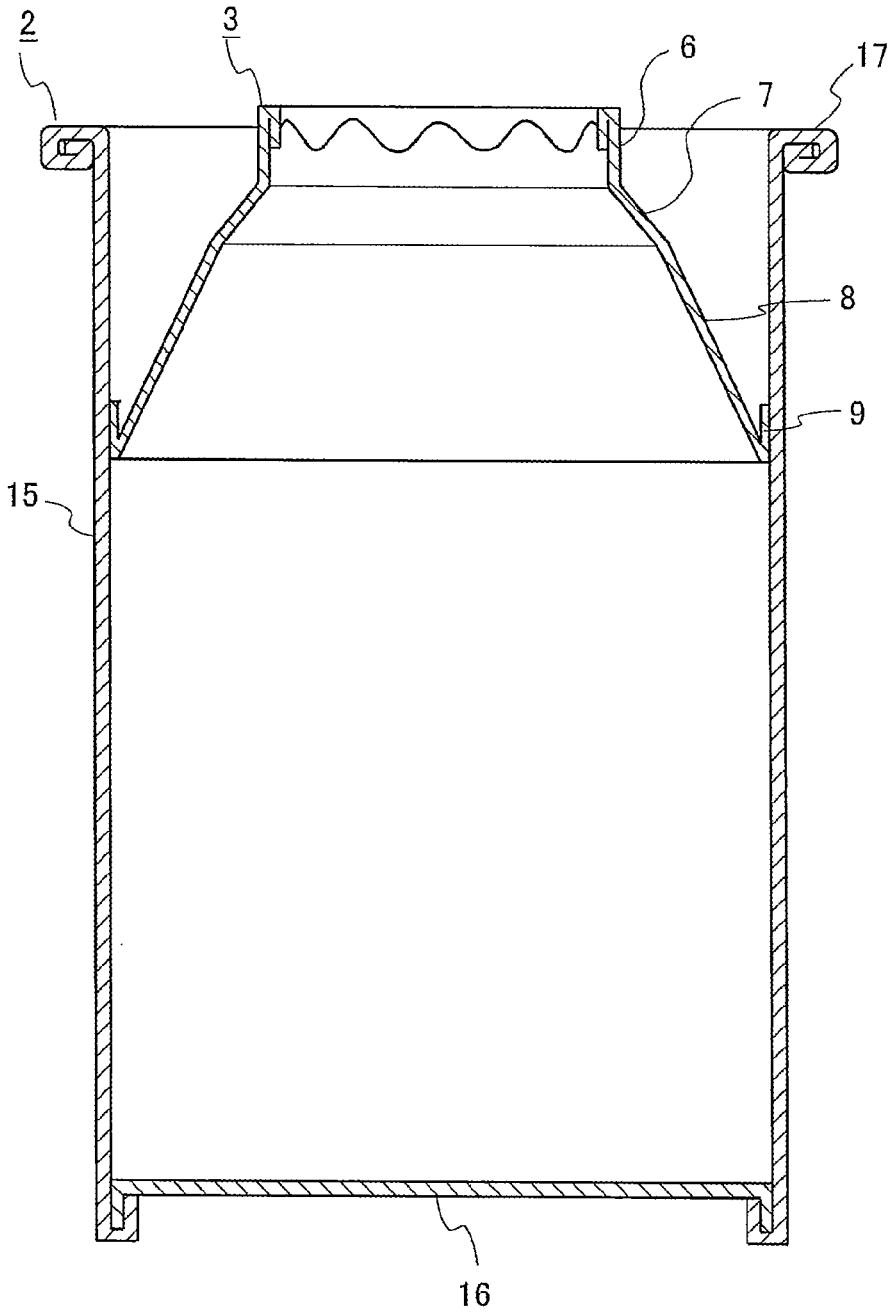
FIG. 12C illustrates a manufacturing process subsequent to the process shown in FIG. 12B.
Figure 13:
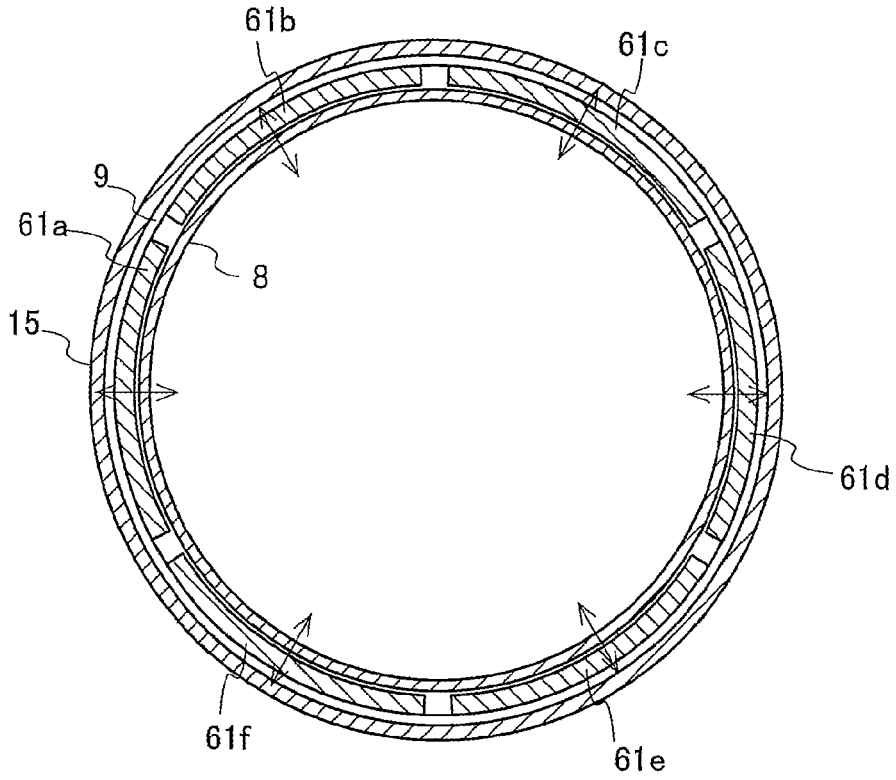
FIG. 13 is a cross-sectional view as taken along a line B-B' shown in FIG. 12B.

FIG. 12A to 12C are each a cross-sectional view illustrating a method for attaching the funnel component to the container body. FIG. 13 is a cross-sectional view as taken along a line B-B' shown in FIG. 12B.

Firstly, as shown in FIG. 12A, the funnel component 3 is held by means of a chuck 60 that has been inserted through the narrow opening portion of the funnel component 3 into the funnel component 3, and the outer surface of the side wall portion 9 and the inner surface of the container body 2 are heated to melt a sealant. Next, the chuck 60 is moved to insert the funnel component 3 into the container body 2, to position the funnel component 3 at an attaching position indicated by an alternate long and two short dashes line. The side wall portion 9 of the funnel component 3 has creases formed therein and is thus formed so as to be contracted in the circumferential direction, and the outer diameter of the side wall portion 9 is less than the inner diameter of the container body 2. Therefore, the funnel component 3 can be inserted into the container body 2 without bringing the side wall portion 9 into contact with the inner wall of the container body 2. As a result, generation of resin scraps and reduction in welding strength due to friction between the side wall portion 9 of the funnel component 3 and the inner surface of the container body 2 can be prevented. When the funnel component 3 and the container body 2 are sealed with each other, both the outer surface of the side wall portion 9, and a portion, of the inner surface of the container body 2, to be sealed with the side wall portion 9 are preferably heated. However, one of the outer surface of the side wall portion 9 or a portion, of the inner surface of the container body 2, to be sealed with the side wall portion 9 may be heated to melt the sealant.

Next, as shown in FIGS. 12B and 13, expanding members 61*a* to 61*f* are used to join the side wall portion 9 to the container body 2. The expanding members 61*a* to 61*f* are aligned in the circumferential direction of the funnel component 3, are movable in the radial direction of the funnel component 3, and move outward in the radial direction to press and attach the side wall portion 9 to the inner surface of the container body 2. The container body 2 is held by a jig (not shown) having a circumferential surface corresponding to the outer circumferential surface of the side wall 15. The side wall portion 9 may be press and attached multiple times by means of the expanding members 61*a* to 61*f*. The sealant is hardened by the pressing and attaching by the expanding members 61*a* to 61*f* and cooling, thereby fixing the funnel component 3 to the container body 2 as shown in FIG. 12C.

Figure 14:
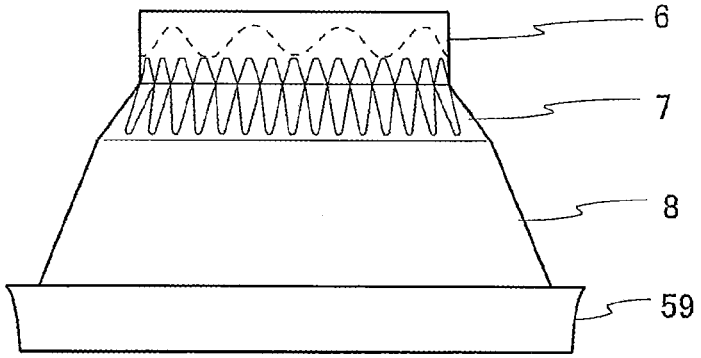
FIG. 14 is a cross-sectional view illustrating warping of a side wall portion of the funnel component.

FIG. 14 is a cross-sectional view illustrating warping of the side wall proton of the funnel component.

The funnel component shown in FIG. 14 has the discharge portion 6, the first tapered portion 7, and the second tapered portion 8 that are the same as those of the funnel component 3 shown in FIG. 3, and is different from the funnel component 3 in that a side wall portion 59 has no creases. As described above, the side wall portion 59 is formed by a wide open portion of an intermediate product in a circular truncated cone shape being folded back outward. Therefore, a circumferential length is different between a folding line portion of the side wall portion 59 and an edge portion thereof. Therefore, while a temperature of the sheet member is high immediately after the side wall portion 59 is formed, the side wall portion 59 is allowed to maintain almost a uniform outer diameter. However, when the sheet member is contracted due to cooling, the edge portion having a great circumferential length is extended to generate warping in the side wall portion 59.

In a case where the outer diameter of the side wall portion 59 is not uniform, and the side wall portion 59 is not stretchable, when the funnel component is inserted into the container body, contact between the side wall portion 59 and the inner surface of the container body cannot be avoided. As a result, resin scraps may be generated or the sealant may be scratched, to reduce welding strength.

On the other hand, in the present embodiment, the funnel component 3 is structured such that the side wall portion 9 is stretchable in the circumferential direction, and, in a state where the side wall portion 9 is contracted, the funnel component 3 is inserted into the container body 2, and the side wall portion 9 is thereafter extended and pressed and attached to the container body 2. Therefore, reduction in welding strength due to the melted and softened sealant being partially scratched is less likely to occur. Further, the resin on the inner surface of the container body 2 is less likely to become rough, or generation of powdery or thread-like resin scraps can be reduced.

<6. Sealing of Open End of Container Body>

After the container body 2 having been assembled as shown in FIG. 12C is filled with the contents 80, the flange portion 17 is heat-sealed with the sealing lid 4 so as to cover the open end portion of the container body 2, and thus the packaging container 1 shown in FIG. 1 is completed. The filling with the contents 80 may be performed by using a nozzle that is inserted through the narrow opening portion of the funnel component 3.

<7. Modification of Manufacturing Method for Manufacturing Container Body>

Modification of step 2 of forming the container body 2 described above will be described below.

Figure 15:
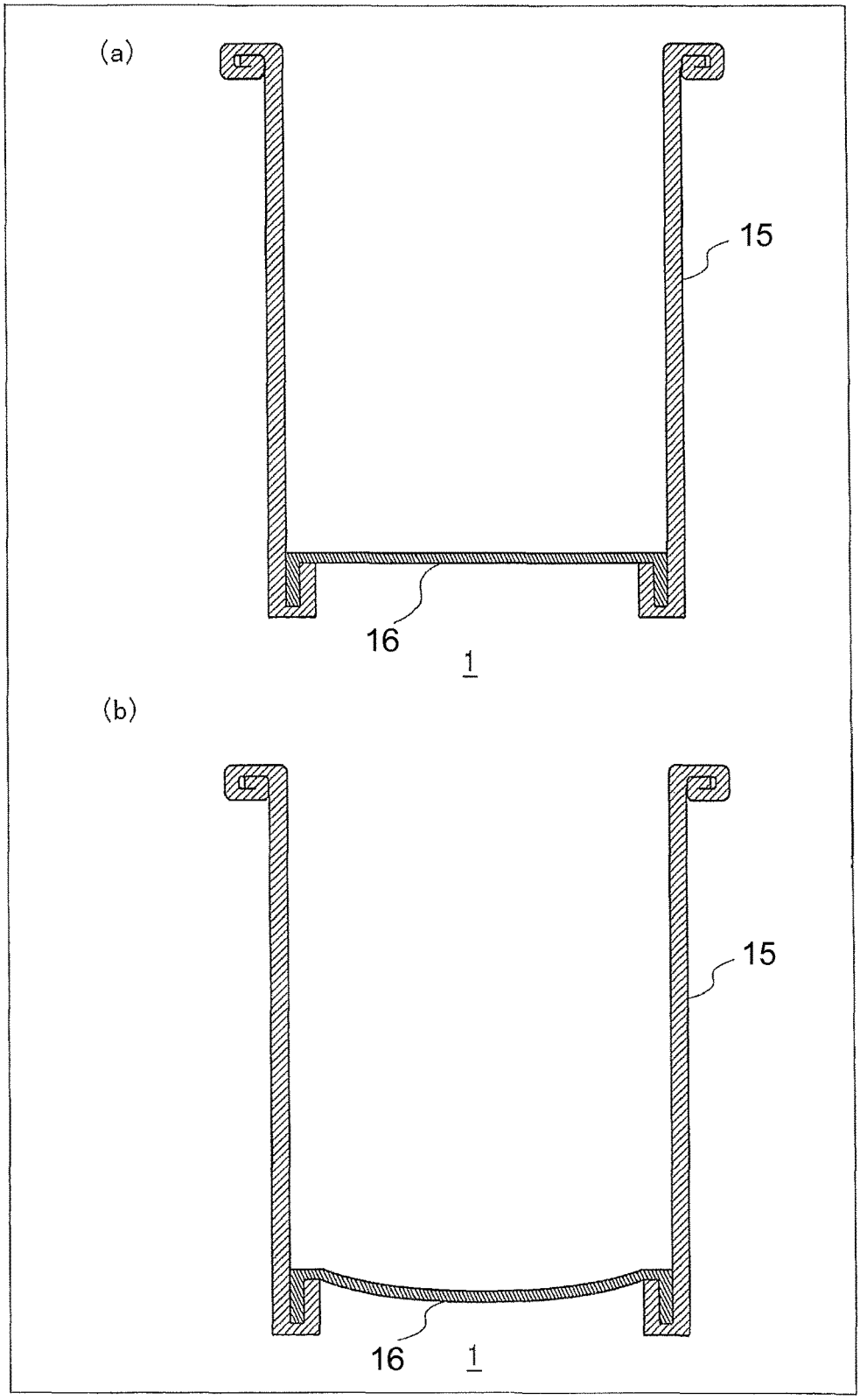
FIG. 15 is a schematic cross-sectional view of a packaging container according to an embodiment of the present invention.

Firstly, the container body 2 manufactured in the modification will be described. FIG. 15 is a schematic cross-sectional view of the container body 2.

The height of the side wall 15 is, for example, 180 mm, and the outer diameter of the side wall 15 is, for example, 95 mm. A bottom portion 16 is provided on the lower end side of the side wall 15. For example, the bottom portion 16 is provided so as to have a height that corresponds to a certain distance from the lower end of the side wall 15 toward the upper end side. More specifically, the bottom portion 16 is provided so as to be higher than the lower end of the side wall 15 by 8 mm in a direction toward the upper end side. The outer edge of the bottom portion 16 connects with the inner side surface of the side wall 15. In FIG. 15, an opening is formed at the upper portion of the packaging container 1. As in conventional packaging containers, when the contents 80 are packaged in the packaging container 1, the opening is sealed, whereby the inner portion of the packaging container 1 is hermetically sealed. In an example shown in (a) of FIG. 15, the bottom portion 16 forms a flat surface. In an example shown in (b) of FIG. 15, the center portion of the bottom portion 16 is expanded outward of the packaging container 1.

Figure 17:
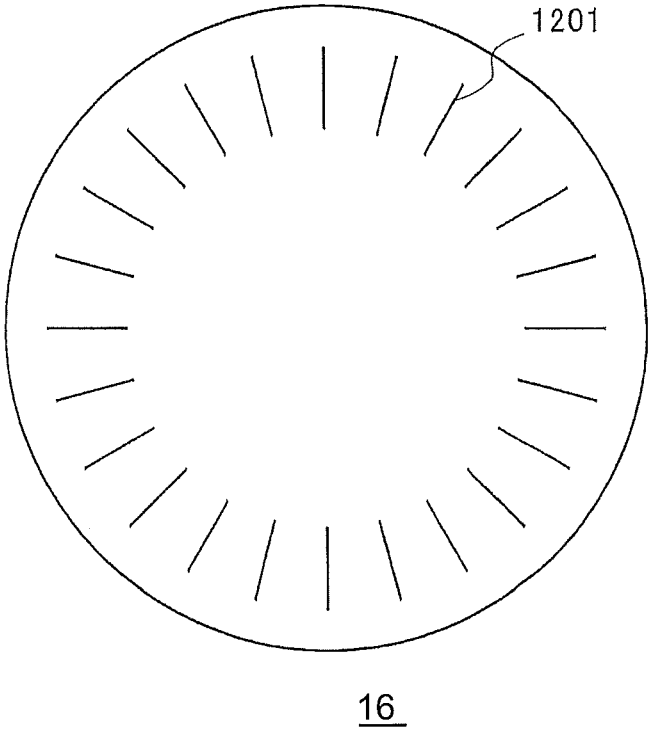
FIG. 17 is an external view of a bottom portion of a packaging container as viewed from the outside of the packaging container, according to the embodiment of the present invention.
Figure 18:
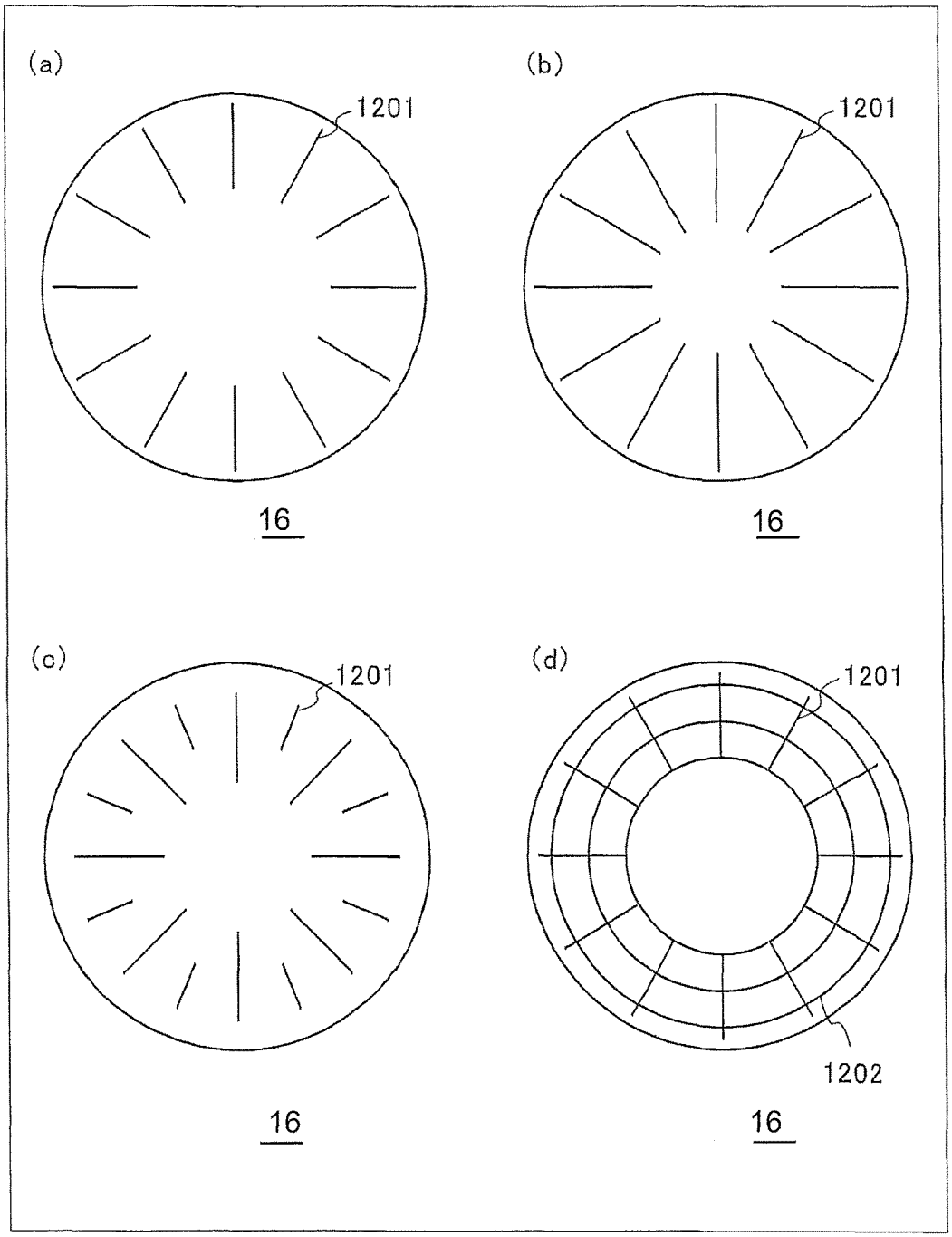
FIG. 18 is an external view of bottom portions of packaging containers as viewed from the outside of the packaging containers, according to a first to a fourth modifications of the embodiment of the present invention.

FIG. 17 is an external view of the bottom portion 16 shown in FIG. 15 as viewed from the outside of the packaging container 1. In an example shown in FIG. 17, 24 ruled lines 1201 are provided on the outer surface of the bottom portion 16 at regular intervals so as to radially extend as viewed from the center portion of the bottom portion 16. In this example, the length of each of the ruled lines 1201 is 12 mm. Further, (a) of FIG. 18 is an external view of the bottom portion 16 according to a modification. In the first modification, 12 ruled lines 1201 are provided on the outer surface of the bottom portion 16 at regular intervals so as to radially extend as viewed from the center portion of the bottom portion 16. In the first modification, the length of each of the ruled lines 1201 is 22 mm. In FIG. 17 and FIG. 18, the solid lines in the circle represent the ruled lines. The number of the ruled lines is calculated such that each of the ruled lines that radially extend as viewed from the center portion of the bottom portion 16 is one ruled line. Namely, a set of the ruled lines that are point-symmetric with respect to the center of the bottom portion 16 is calculated as two ruled lines.

The number of the ruled lines 1201 and the length of each ruled line 1201 are not limited to these examples. Other examples are shown in (b), (c), and (d) of FIG. 18. (b) of FIG. 18 is an external view illustrating the bottom portion 16, of a second modification, in which 12 ruled lines 1201 each having a length of 30 mm are provided. Further, (c) of FIG. 18 is an external view illustrating the bottom portion 16, of a third modification, in which 8 ruled lines 1201 each having a length of 12 mm and 8 ruled lines 1201 each having a length of 22 mm are provided at regular intervals such that the ruled line 1201 having the length of 12 mm and the ruled line 1201 having the length of 22 mm are alternately provided. Furthermore, the ruled lines may not be equally spaced from each other.

The length of each ruled line 1201 may be greater than or equal to 5 mm and less than 100 mm. The number of the ruled lines 1201 may be greater than or equal to 6 and less than 30. When the length of each ruled line 1201 is less than the above length, or the number of the ruled lines 1201 is less than the above number, crinkling is likely to occur. On the other hand, when the length of each ruled line 1201 is greater than the above length, or the number of the ruled lines 1201 is greater than the above number, rigidity of the bottom portion 16 is excessively reduced, and the strength of the packaging container is reduced. The number of the ruled lines 1201 is particularly preferably greater than or equal to 6, and less than 25.

Further, a fourth modification as shown in (d) of FIG. 18 may be implemented in which, in addition to 12 ruled lines 1201, circular lines 1202 that intersect the 12 ruled lines 1201 may be provided, on the outer surface portion of the bottom portion 16, around the center portion of the bottom portion 16.

In each of the above examples, the ruled lines 1201 are not formed in the center portion of the bottom portion 16. However, the ruled lines 1201 may pass through the center portion of the bottom portion 16.

Figure 19:
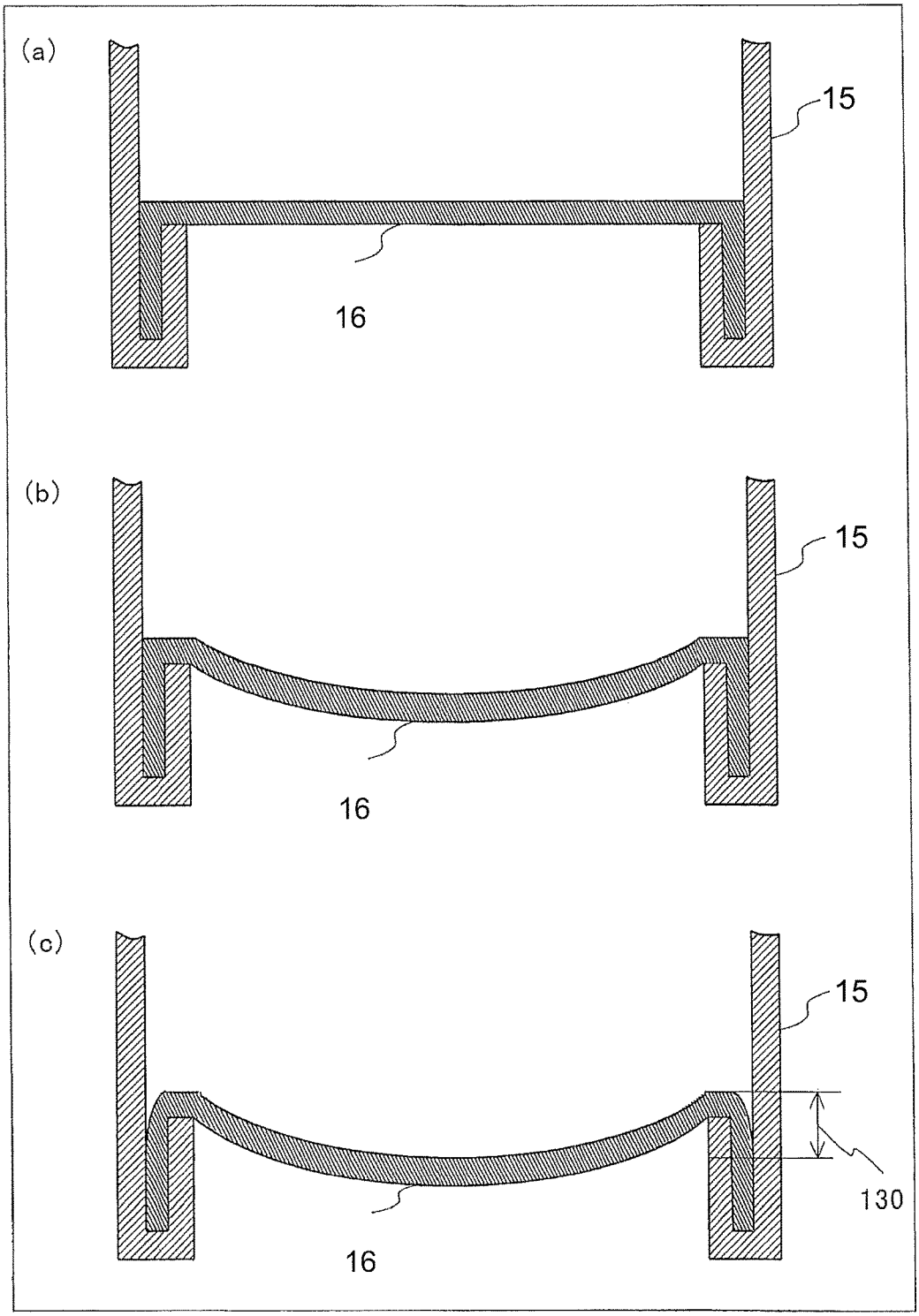
FIG. 19 is a schematic cross-sectional view of a portion, near the bottom portion, of the packaging container according to the embodiment of the present invention.

(a) of FIG. 19 is a schematic cross-sectional view of a portion, near the bottom portion 16, of the packaging container 1 shown in (a) of FIG. 15. In the example shown in (a) of FIG. 15, the bottom portion 16 forms a flat surface without expansion, and the ruled lines 1201 (and/or the lines 1202) are simply formed. Further, (b) of FIG. 19 is a schematic cross-sectional view illustrating a portion, near the bottom portion 16, of the packaging container 1 shown in (b) of FIG. 15. In the examples shown in (b) of FIG. 15 and (b) of FIG. 19, the center portion of the bottom portion 16 is expanded outward of the packaging container 1 by 5 mm as compared to the height of the outer edge of the bottom portion 16. As shown in FIG. 15 and FIG. 19, the lower end portion of the side wall 15 is bent inward, and a planar fixing portion that can be bent is provided outside the substantially outer edge of the bottom portion 16. The fixing portion is inserted into a gap formed by the side wall 15 having been bent, and the fixing portion and the side wall 15 are thereafter adhered to each other, to fix the bottom portion 16 to the side wall 15.

(c) of FIG. 19 is a schematic cross-sectional view illustrating a modification of a portion, near the bottom portion 16, of the packaging container 1. In an example shown in (c) of FIG. 19, the fixing portion at the outer edge of the bottom portion 16 and the side wall 15 that sandwiches the fixing portion are adhered to each other so as to reach a predetermined height from a bending portion, of the side wall 15, which forms the lower end of the packaging container 1, thereby assuredly sealing the packaging container 1 hermetically, and a non-sealed portion 130 in which no adhesion is performed is formed thereabove. In this example, the more greatly the center portion of the bottom portion 16 is expanded outward of the packaging container 1, the more greatly the non-sealed portion 130 of the fixing portion at the outer edge of the bottom portion 16 is deformed inward. Therefore, the bottom portion 16 is easily expanded, and expansion can be increased while crinkling that causes poor outer appearance as described below can be reduced with enhanced effectiveness. In a region where the fixing portion at the outer edge of the bottom portion 16, and the side wall 15 overlap each other, the length of the region in which the adhesion is performed preferably ranges from 1 mm to 15 mm, and particularly preferably ranges from 2 mm to 5 mm. Further, the length of the non-sealed portion 130 preferably ranges from 1 mm to 8 mm. When the length of the non-sealed portion 130 is less than or equal to 1 mm, an effect of reducing crinkling that causes poor outer appearance is reduced. When the length is greater than or equal to 8 mm, material cost and production efficiency of the packaging container 1 become worse.

Figure 20:
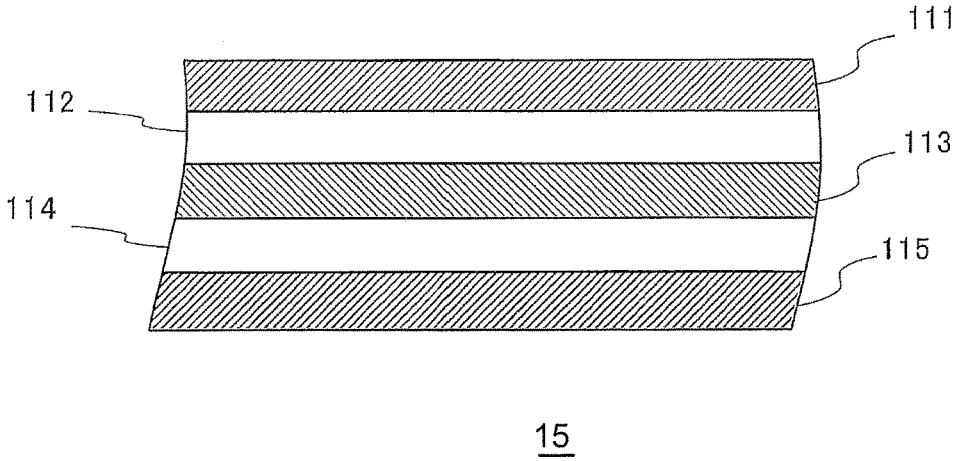
FIG. 20 illustrates a laminated structure of a side surface portion of the packaging container according to the embodiment of the present invention.

FIG. 20 illustrates a laminated structure of the side wall 15 shown in FIG. 15. As shown in FIG. 20, for example, a sheet member in which a polyethylene layer 111, a deposition film 112, a polyethylene terephthalate layer 113, paper 114, and a polyethylene layer 115 are layered in order, respectively, from the inner side toward the outer side of the packaging container 1, can be preferably used as a material by which the side wall 15 is formed. The side wall 15 is formed by resin layers, a film, and paper as described above. Therefore, the side wall 15 has rigidity and is deformable in the thickness direction or the like to some degree.

Figure 21:
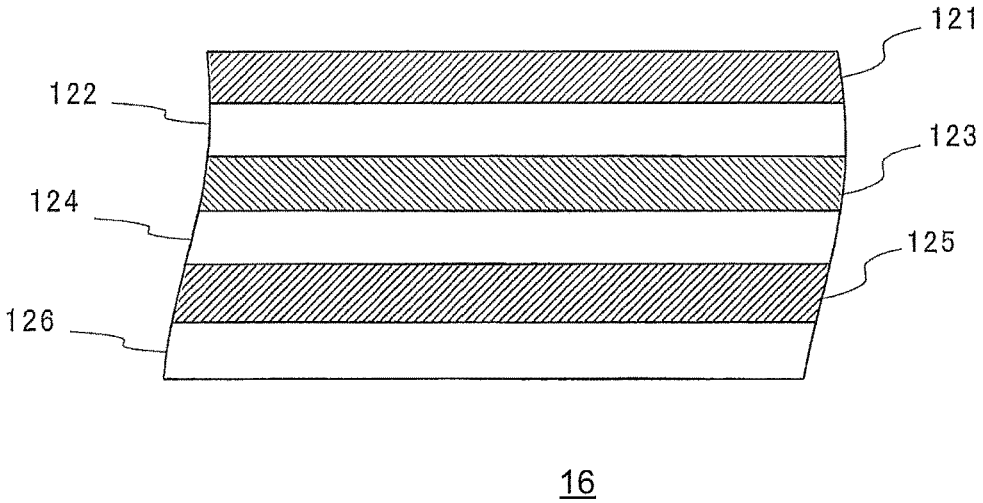
FIG. 21 illustrates a laminated structure of the bottom portion of the packaging container according to the embodiment of the present invention.

FIG. 21 illustrates a laminated structure of the bottom portion 16 shown in FIG. 15 and FIG. 19. As shown in FIG. 21, a sheet member in which a polyethylene layer 121, a deposition film 122, a gas-sealing function resin layer 123, a polyethylene layer 124, paper 125, and a polyethylene layer 126 are layered in order, respectively, from the inner side toward the outer side of the packaging container 1, can be preferably used as a material by which the bottom portion 16 is formed. The gas-sealing function resin layer is, for example, a resin layer formed by an ethylene-vinylalcohol copolymer. The bottom portion 16 is formed by the resin layers, a film, and paper as described above. Therefore, the bottom portion 16 has rigidity, and is deformable in the thickness direction or the like to some degree.

Figure 16:
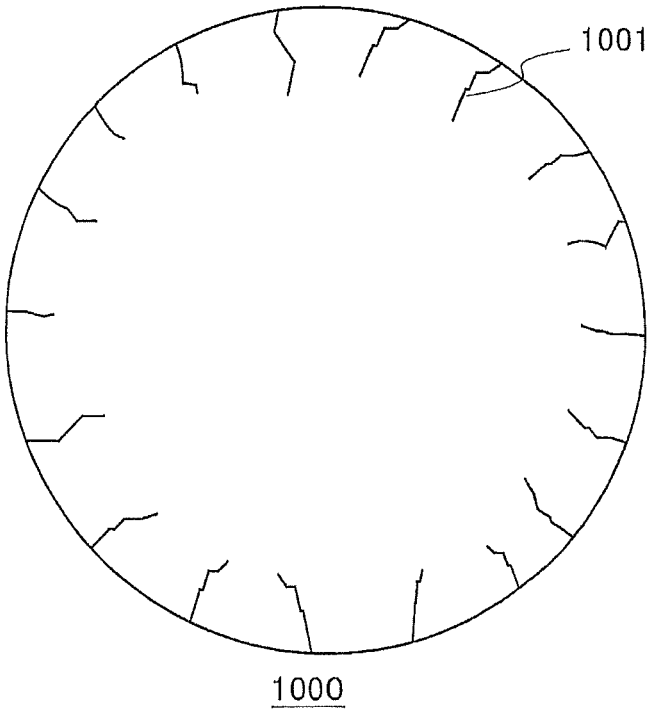
FIG. 16 illustrates crinkles on a bottom portion of a packaging container associated with a problem to be solved by the present invention.

In the examples shown in (b) of FIG. 15, and (b) and (c) of FIG. 19, when the bottom portion 16 is expanded, stress generated near the outer edge of the bottom portion 16 is reduced by the ruled lines 1201 being compressed to reduce their widths, and the stress is dispersed over the entirety of the bottom portion 16. Further, when the ruled lines 1201 are provided, for example, crinkling occurs along the ruled lines 1201, whereby the crinkles are absorbed and become undistinguished. Thus, since generation of crinkles in the bottom portion 16 is reduced, the design of the packaging container 1 is prevented from being degraded and the bottom portion 16 can be sufficiently expanded. On the other hand, when the ruled lines 1201 are not provided, since stress is concentrated on a portion, near the outer edge, of the bottom portion 16, crinkles 1001 are generated as in a bottom portion 1000 shown in FIG. 16, whereby the design is degraded, and expansion becomes insufficient. In order to more assuredly reduce generation of crinkles, the non-sealed portion 130 may be provided as shown in (c) of FIG. 19. Further, in the bottom portion 16 shown in (d) of FIG. 18, the circular lines 1202 as well as the ruled lines 1201 enable reduction of the stress, and further enables absorption of crinkles.

Further, even in an environment in which air pressure outside the packaging container 1 is higher than air pressure thereinside, since the rigidity of the bottom portion 16 is lower than the rigidity of the side wall 15, expansion of the bottom portion 16 is reduced or the bottom portion 16 is further recessed toward the inner side of the packaging container 1, thereby absorbing difference in air pressure. On the other hand, the side wall 15 having a distinguishable outer appearance is not deformed. Therefore, the design of the packaging container 1 is not degraded. For example, the packaging container 1 was filled with powdery substances of instant coffee at 30° C., and the opening was thereafter sealed, and the packaging container 1 was left as it was in an environment in which the temperature was 0° C. Namely, the packaging container 1 containing the contents 80 was left as it was in an environment in which air pressure outside the packaging container 1 was higher than air pressure thereinside. In this case, expansion of the bottom portion 16 was reduced, and the side wall 15 having a distinguishable outer appearance was not deformed. Namely, the design of the packaging container 1 was not degraded as a whole.

Thus, in the examples shown in (b) of FIG. 15 and (b) and (c) of FIG. 19, in a case where air pressure inside the packaging container 1 is lower than air pressure thereoutside, the difference in air pressure is absorbed. Therefore, the bottom portion 16 is previously expanded outward of the packaging container. However, in a case where, as shown in (a) of FIG. 15 and (a) of FIG. 19, the bottom portion 16 is not previously expanded, when, for example, packaging containers in which the contents 80 are packaged at a place where the altitude is low are circulated and placed in a place where the altitude is high, and air pressure inside the packaging containers becomes higher than air pressure thereoutside, the bottom portion 16 is expanded outward of the packaging container without generating crinkles to absorb difference in air pressure, and expansion of the side wall 15 is prevented. Therefore, difference in air pressure can be absorbed without degrading the design of the packaging container.

Next, a manufacturing method for manufacturing the packaging container 1 according to the present embodiment will be described.

Firstly, on one of flat surfaces of a bottom member 12*a* which is to be later formed into the bottom portion 16 of the container body 2, ruled lines are formed as illustrated in one of the examples shown in FIG. 17 and FIG. 18. Specifically, a plurality of ruled lines are formed on one of the flat surfaces of the bottom member 12*a* so as to radially extend as viewed from the center portion thereof.

The bottom member 12*a* is fixed to the side wall 15 on the lower end side of the side wall 15 of the packaging container 1. Specifically, the lower end portion of the side wall 15 is folded back inward to sandwich and seal the fixing portion that is an outer edge portion of the bottom member 12*a*. At this time, as shown in (c) of FIG. 19, an overlapping portion where the fixing portion of the bottom member 12*a* and the side wall 15 overlap each other, may be sealed such that a portion, of the overlapping portion, from the folding-back position to a predetermined height is sealed, and a portion of the overlapping portion higher than the predetermined height is not sealed. In the present embodiment, the bottom member 12*a* is fixed to the side wall 15 up to a height that corresponds to a certain distance from the lower end of the side wall 15 toward the upper end side, for example, up to a height which correspond to the distance of 8 mm Δt this time, the bottom member 12*a* is fixed to the side wall 15 such that the surface having the ruled lines is positioned at the lower end side of the side wall 15, and an outer edge contacts with the inner side surface of the side wall 15. Since the bottom member 12*a* is to be later formed into the bottom portion 16 of the packaging container 1, the structure of the bottom member 12*a* is the same as the structure of the bottom portion 16 described in the embodiment. As described above, the intermediate product 51 described above is formed. When the bottom portion 16 is not previously expanded, a curling portion is subsequently formed (intermediate products 52, 54) and a flange is formed in the above-described steps, to manufacture the container body 2.

Figure 22:
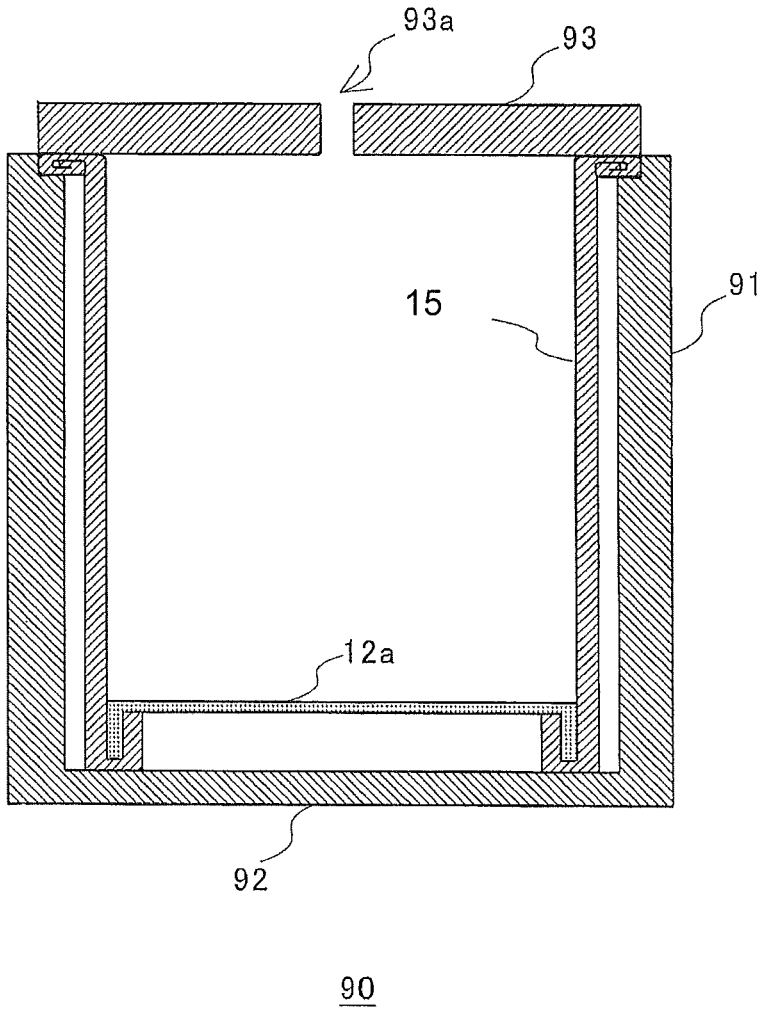
FIG. 22 illustrates a manufacturing method for manufacturing the packaging container according to the embodiment of the present invention.

When the bottom portion 16 is previously expanded, a curling portion is formed (intermediate products 52, 54) and a flange is formed for the intermediate product 51, and thereafter the following steps are further performed. FIG. 22 illustrates a manufacturing method for manufacturing the packaging container 1. As shown in FIG. 22, a cylindrical manufacturing receiver tool 90 is used in the manufacturing method for manufacturing the packaging container 1 of the present invention. The manufacturing receiver tool 90 is a vessel having a high rigidity, and is formed of, for example, aluminium or resin. The manufacturing receiver tool 90 includes a cylindrical side surface portion 91, a circular bottom portion 92, and a lid 93 having a hole 93*a* at the center portion thereof. The bottom portion 92 is fixed to the lower end of the side surface portion 91. The lid 93 is detachably mounted to the top end of the side surface portion 91, so as to cover an opening at the top end of the side surface portion 91. The inner diameter of the side surface portion 91 of the manufacturing receiver tool 90 is, for example, 97 mm, and the height of the side surface portion 91 is, for example, 180 mm.

Firstly, the entirety of the bottom member 12*a* is heated to a temperature ranging from 50° C. to 80° C. For example, the entirety of the bottom member 12*a* is heated to a temperature ranging from 50° C. to 80° C. by hot air being applied to the bottom member 12*a*. The side wall 15 having the bottom member 12*a* fixed thereto is accommodated in the manufacturing receiver tool 90 such that the bottom member 12*a* and the bottom portion 92 of the manufacturing receiver tool 90 oppose each other. For example, when the inner diameter of the side surface portion 91 of the manufacturing receiver tool 90 is 97 mm, and the outer diameter of the side wall 15 of the packaging container 1 is 95 mm, a space of 1 mm is formed between the side surface portion 91 and the side wall 15. After the side wall 15 having the bottom member 12*a* fixed thereto is accommodated in the manufacturing receiver tool 90, an opening at the top of the manufacturing receiver tool 90 is covered with the lid 93. At this time, the hole 93*a* formed in the lid 93 is positioned on the center axis of the side surface portion 91.

Next, air is blown through the hole 93*a* formed in the lid 93 into the manufacturing receiver tool 90 in the axial direction of the side surface portion 91 of the manufacturing receiver tool 90. In practice, air is blown through the hole 93*a* into a space formed by the side wall 15, the bottom member 12*a*, and the lid 93. For example, air is blown through the hole 93*a* into the space at a pressure that is higher than or equal to 1 Mpa and not higher than 10 Mpa for a time period that is longer than or equal to 0.02 seconds and not longer than 10 seconds.

Immediately before air is blown, the temperature of the entirety of the bottom member 12*a* has become a high temperature ranging from 50° C. to 80° C. Therefore, the bottom member 12*a* is softened, and can be easily deformed. In this state, by air being blown into the manufacturing receiver tool 90, the center portion of the bottom member 12*a* accommodated in the manufacturing receiver tool 90 is expanded toward the bottom portion 92 of the manufacturing receiver tool 90. For example, when air is blown at a pressure that is higher than or equal to 1 Mpa and not higher than 10 Mpa for a time period that is longer than or equal to 0.02 seconds and not longer than 10 seconds as described above, the center portion of the bottom member 12*a* is expanded toward the bottom portion 92 by 5 mm. When the bottom member 12*a* is expanded, the bottom member 12*a* becomes the bottom portion 16 shown in (b) of FIG. 15. When the expansion has been formed for the bottom portion 16, the lid 93 is removed, and the side wall 15 having the bottom portion 16 fixed on the lower end side is extracted externally from the manufacturing receiver tool 90. As described above, the container body 2 having the bottom portion 16 expanded can be formed. Thereafter, the curling portion is formed (intermediate products 52, 54) and the flange is formed in the above-described steps, to manufacture the container body 2.

The step of previously forming expansion for the bottom portion 16 may be performed for the intermediate products 51, 52, and 54. Namely, this step may be performed in any stage after the step of sealing the side wall 15 and the bottom member 12*a* with each other and before the container body 2 is filled with the contents 80.

In the container body 2 having been thus manufactured, crinkling as described above does not occur in the bottom portion 16, and when an internal pressure of the packaging container 1 is reduced as compared to an external pressure, recessing of the side wall 15 having a distinguishable outer appearance as described above does not occur, the design of the entirety of the packaging container 1 may not be degraded.

In the above-described example, the bottom member 12*a* is heated before air is blown into the manufacturing receiver tool 90. However, when the bottom member 12*a* is highly flexible, the bottom member 12*a* need not be heated. Whether or not the heating is performed may be determined by conducting a test as appropriate according to flexibility of the bottom member 12*a*, a pressure and an amount of air to be blown, or the like. The temperature for the heating may be also determined by conducting a test as appropriate.

Further, in the above-described example, when air is blown into the manufacturing receiver tool 90, air is blown through the hole 93*a* formed in the lid 93 into the manufacturing receiver tool 90 in the axial direction of the side surface portion 91 of the manufacturing receiver tool 90. However, air may not be blown in the axial direction of the side surface portion 91 of the manufacturing receiver tool 90. For example, air may be blown in the direction angled relative to the axis of the side surface portion 91. Further, the hole 93*a* in the lid 93 may not be formed on the center axis of the side surface portion 91.

Further, in the above-described example, when air is blown into the manufacturing receiver tool 90, air is blown at a pressure that is higher than or equal to 1 Mpa and not higher than 10 Mpa for a time period that is longer than or equal to 0.02 seconds and not longer than 10 seconds. However, the pressure of air to be blown and the time period for which air is blown are not limited to the above-described conditions. The pressure of air to be blown and the time period for which air is blown may be determined by conducting a test as appropriate according to flexibility of the bottom member 12*a*, heated state of the bottom member 12*a*, or the like.

Further, in the above-described example, when air is blown into the manufacturing receiver tool 90, the entirety of the bottom member 12*a* to be later formed into the bottom portion 16 of the packaging container 1 is heated to a temperature ranging from 50° C. to 80° C. However, a portion of the bottom member 12*a*, for example, an area that is 30% or more of the flat surface of the bottom member 12*a* may be heated to a temperature ranging from 50° C. to 80° C. Also in this case, the bottom member 12*a* is softened and can be easily deformed. Therefore, when, in this state, air is blown into the manufacturing receiver tool 90, the center portion of the bottom member 12*a* accommodated in the manufacturing receiver tool 90 is expanded toward the bottom portion 92 of the manufacturing receiver tool 90.

Further, in the above-described example, the center portion of the bottom member 12*a* is expanded by air being blown, to form the bottom portion 16 forming a portion of the packaging container 1. However, the center portion of the bottom member 12*a* may be expanded by using upper and lower molds, to form the bottom portion 16.

The step of forming expansion for the bottom portion 16 and the other steps may be performed in a temporally sequential manner. However, the expansion may be formed for the bottom portion 16, temporally separately from the other steps, immediately before the packaging container 1 is filled with the contents 80, in order to assuredly maintain the expansion of the bottom portion 16 when the packaging container 1 is sealed. Alternatively, the step of forming expansion for the bottom portion 16 and the other steps are performed in a temporally sequential manner, and, for example, the bottom portion 16 may be further drawn from the outside of the packaging container 1 immediately before the contents 80 is fully supplied, and therefore, even when the expansion is recessed during transportation or the like, the expansion may be restored.

Hereinafter, evaluation results of the packaging container 1 and the manufacturing method thereof according to the modifications will be described.

(Evaluation Result 1)

In a case where the bottom portion 16 of the packaging container 1 having no ruled lines and the bottom portions 16 of the packaging containers 1 having the ruled lines illustrated in each of the examples shown in FIG. 17 and FIG. 18 were prepared, when air pressure inside the packaging containers 1 became lower than air pressure thereoutside, and the bottom portions 16 were recessed, whether or not crinkles were generated near the outer edges of the bottom portions 16, was determined. The determination results are indicated below in "crinkles that degraded outer appearance" in Table 1. In the column, "+" represents a case where no crinkles were generated, and "−" represents a case where crinkles were generated. In Table 1, an amount of expansion of the center portion of the bottom portion 16 relative to the outer edge thereof is indicated as "depth of expansion". Further, the expansion of the bottom portion 16 was formed, in the above-described manufacturing method, by blowing air at 1 MPa for 0.2 seconds.

TABLE 1

| Whether or not ruled lines were provided | Depth of expansion (mm) | Crinkle that degraded outer appearance |
|---|---|---|
| No ruled lines were provided (comparative example) | 3.5 | − |
| Ruled lines were provided (FIG. 17 24 ruled lines each having length of 12 mm) | 4.0 | + |
| Ruled lines were provided ((a) of FIG. 18 12 ruled lines each having length of 22 mm) | 5.0 | + |
| Ruled lines were provided ((b) of FIG. 18 12 ruled lines each having length of 30 mm) | 5.5 | + |
| Ruled lines were provided ((c) of FIG. 18 8 ruled lines each having length of 12 mm + 8 ruled lines each having length of 22 mm) | 5.4 | + |
| Ruled lines were provided ((d) of FIG. 18 12 ruled lines | 6.0 | + |

TABLE 1-continued

| Whether or not ruled lines were provided | Depth of expansion (mm) | Crinkle that degraded outer appearance |
|---|---|---|
| each having length of 22 mm + circular lines) | | |

As indicated in Table 1, in the bottom portion 16 having no ruled lines, crinkles were generated near the outer edge of the bottom portion 16. On the other hand, in the bottom portions 16 having the ruled lines illustrated in each of the examples shown in FIG. 17 and FIG. 18, no crinkles were generated near the outer edges of the bottom portions 16. Thus, it was confirmed that, when the ruled lines were provided on the outer surface portion of the bottom portion 16, even when air pressure inside the packaging container 1 became lower than air pressure thereoutside, and the bottom portion 16 was recessed, crinkles that degraded the design were not generated near the outer edge of the bottom portion 16.

(Evaluation Result 2)

Figure 23:
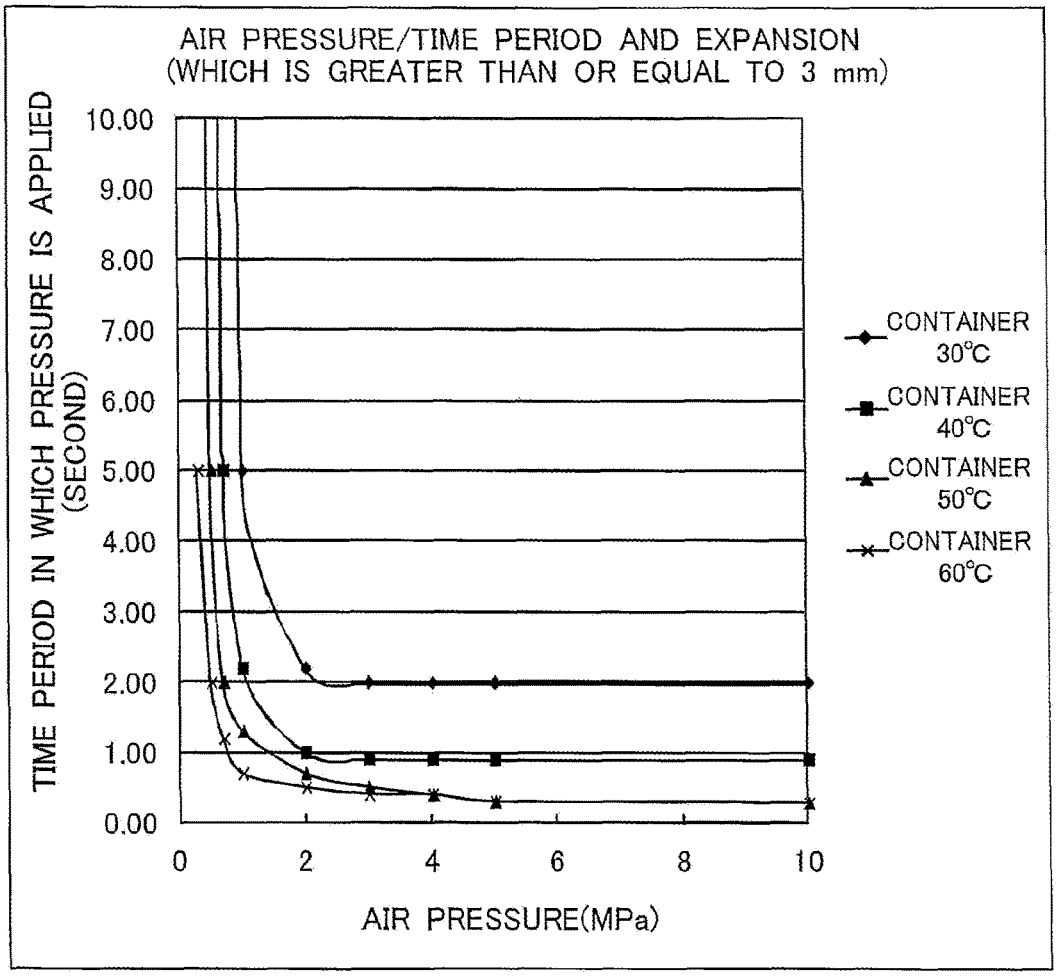
FIG. 23 illustrates a relationship between pressure of air to be blown and a time period for which air is blown in the manufacturing method for manufacturing the packaging container according to the embodiment of the present invention.

A relationship between a pressure of air to be blown and a time period for which air is blown was determined for the manufacturing method described herein when the bottom portion 16 having an expansion of 3 mm was formed at the center portion thereof by blowing air to the center portion of the bottom member 12*a*. The determination results are as shown in FIG. 23. As shown in FIG. 23, it was confirmed that the bottom portion 16 having an expansion of 3 mm at the center portion thereof was formed by blowing air at a pressure that was higher than or equal to 1 Mpa and not higher than 10 Mpa for a time that was longer than or equal to 0.02 seconds and not longer than 10 seconds.

As described above, embodiments according to the present invention are useful for a manufacturing method for manufacturing packaging containers used to facilitate transfer of fluid contents such as powdery, granular, and liquid contents from one case to another case.

DESCRIPTION OF THE REFERENCE CHARACTERS

1 packaging container
2 container body
3 funnel component
4 sealing lid
5 tab
6 discharge portion
7 first tapered portion
8 second tapered portion
9 side wall portion
10 folded portion
11 embossed portion
12*a* bottom member
13 funnel portion
14 crease
15 side wall
16 bottom portion
17 flange portion
18 lower film
19 upper film
21, 21*b* blank material
22, 23, 24 intermediate product
25 arc
27 corrugated line portion
28 container to be filled
30 funnel component
31 discharge portion
32 tapered portion
33 side wall portion
35 funnel portion
36 blank material
37 ruled line
38, 39, 42 intermediate product
40 narrow open portion
41 tapered portion
45 folded portion
46, 47, 48 arc
51, 52, 54 intermediate product
53, 55 curling portion
56 mold
59 side wall portion
60 chuck
61*a* expanding member
80 contents
90 manufacturing receiver tool
91 side surface portion
92 bottom portion
93 lid
93*a* hole
111 polyethylene layer
112 deposition film
113 polyethylene terephthalate layer
114 paper
115 polyethylene layer
121 polyethylene layer
122 deposition film
123 gas-sealing function resin layer
124 polyethylene layer
125 paper
126 polyethylene layer
130 non-sealed portion
1000 bottom portion
1001 crinkle
1201, 1202 ruled line

The invention claimed is:

1. A manufacturing method for manufacturing a packaging container having a funnel component that is formed of a first sheet member including paper and a first sealant and includes: a funnel portion having a diameter reduced from a wide opening side toward a narrow opening side; and a side wall portion that connects to a wide opening side portion of the funnel portion and surrounds an outer surface of the funnel portion, the manufacturing method comprising:

forming a cup-shaped container body having a cylindrical side wall, a bottom portion, and an open end, the forming the container body including:

forming a cup-shaped intermediate product having: a cylindrical side wall formed of a second sheet member that includes paper and a second sealant; a bottom portion formed of a third sheet member that includes paper and a third sealant; and an open end;

forming a first curling portion by curling an open end portion of the side wall of the cup-shaped intermediate product outward;

softening the second sealant by heating a portion, on a bottom portion side, of the first curling portion;

forming a second curling portion by further curling outward the first curling portion having the second sealant softened; and forming a flange portion by pressing the second curling portion; and inserting the funnel component through the open end of the container body to face the wide opening side portion of the funnel component toward the bottom portion of the container body, and joining an outer surface of the side wall portion to an inner circumferential surface of the container body.

2. The manufacturing method for manufacturing the packaging container according to claim 1, wherein the joining the outer surface of the side wall portion to the inner circumferential surface of the container body includes:

heating and softening the second sealant on the outer surface of the side wall portion;

holding the funnel component in a state where the side wall portion of the funnel component is contracted in a circumferential direction such that an outer diameter of the side wall portion is less than an inner diameter of the open end of the container body, and inserting the funnel component into the container body so as to face the wide opening side portion toward the bottom portion of the container body; and pressing and widening the side wall portion of the funnel component inserted in the container body, and pressing and attaching the side wall portion to an inner surface of the side wall of the container body.

3. The manufacturing method for manufacturing the packaging container according to claim 1, wherein the joining the outer surface of the side wall portion to the inner circumferential surface of the container body further includes heating and softening the second sealant in a portion, of the inner surface of the side wall of the container body, to which the side wall portion of the funnel component is sealed, before inserting the funnel component into the container body.

4. The manufacturing method for manufacturing the packaging container according to claim 1, further comprising sealing, after the joining the outer surface of the side wall portion to the inner circumferential surface of the container body, the open end of the container body with a film that is to be broken by a pressing force after the container body is filled with contents.

5. The manufacturing method for manufacturing the packaging container according to claim 1, wherein the side wall has a rigidity higher than the bottom portion;

the forming the cup-shaped intermediate product includes:

forming a plurality of ruled lines on one of surfaces of a bottom member formed of the third sheet member so as to radially extend as viewed from a center portion; and forming the bottom portion by sealing the bottom member having the ruled lines, and a lower end side portion of the side wall with each other such that a surface on which the ruled lines are formed is positioned outside.

6. The manufacturing method for manufacturing the packaging container according to claim 5, further comprising:

covering an opening at a top of the side wall, except for a portion of the opening, with a receiver tool, after the forming the bottom portion; and expanding, after the forming the bottom portion, a center portion of the bottom portion by blowing air through the portion of the opening into a space formed by the bottom portion and the side wall.

7. The manufacturing method for manufacturing the packaging container according to claim 5, wherein in the forming the bottom portion, a lower end portion of the side wall is folded back inward, to sandwich an outer edge portion of the bottom member in an overlapping manner, and an overlapping portion in a region from a folding-back position to a predetermined height is sealed, and the overlapping portion in a region higher than the predetermined height is not sealed.

8. The manufacturing method for manufacturing the packaging container according to claim 6, further comprising heating the bottom portion to a temperature that is higher than or equal to 50° C. and not higher than 80° C. before the step of expanding the center portion of the bottom portion.

9. The manufacturing method for manufacturing the packaging container according to claim 6, wherein the opening is covered except for a center portion of the opening in the step of covering with the receiver tool.

10. The manufacturing method for manufacturing the packaging container according to claim 6, wherein air is blown at a pressure that is higher than or equal to 1 MPa and not higher than 10 MPa for a time period that is longer than or equal to 0.02 seconds and not longer than 10 seconds in the expanding the center portion of the bottom portion.

11. The manufacturing method for manufacturing the packaging container according to claim 1, further comprising, prior to the inserting the funnel component:

by using the first sheet member, forming the funnel component by forming a blank material surrounded by an arc, a pair of straight lines that extends in a radial direction of the arc, and a corrugated line that extends to form an arc that is concentric with the arc and has a radius less than the arc, by punching the first sheet member by using a die, forming a first intermediate product that is tapered, by rolling the blank material, and causing portions near the paired straight lines to overlap each other and be welded to each other, forming a second intermediate product by folding back and welding the corrugated line portion of a narrow opening side portion of the first intermediate product over the entirety of a circumference of the corrugated line portion, forming a third intermediate product having the side wall portion by folding the wide opening side portion of the second intermediate product back outward over the entirety of a circumference of the wide opening side portion, and forming a cylindrical discharge portion forming the narrow opening side portion, a first tapered portion that connects to the discharge portion and has a tapered shape, and a second tapered portion that connects to the first tapered portion and has a tapered shape having a taper angle less than the first tapered portion, by performing a pressing process on the third intermediate product by using a mold to perform a drawing process.

* * * * *